US007472676B2

(12) United States Patent
McCoin et al.

(10) Patent No.: US 7,472,676 B2
(45) Date of Patent: Jan. 6, 2009

(54) DIFFERENTIAL WITH GUIDED FEEDBACK CONTROL FOR ROTARY OPPOSED-PISTON ENGINE

(76) Inventors: Dan K. McCoin, 117 Little John Ct., El Paso, TX (US) 79924; Mark D. McCoin, 4629 W. Laredo St., Chandler, AZ (US) 85226

( * ) Notice: Subject to any disclaimer, the term of this patent is extended or adjusted under 35 U.S.C. 154(b) by 0 days.

(21) Appl. No.: 11/279,537

(22) Filed: Apr. 12, 2006

(65) Prior Publication Data

US 2006/0225691 A1 Oct. 12, 2006

Related U.S. Application Data

(60) Provisional application No. 60/670,567, filed on Apr. 12, 2005.

(51) Int. Cl.
*F02B 53/00* (2006.01)

(52) U.S. Cl. ..... 123/241; 123/245; 418/36; 418/38

(58) Field of Classification Search ..... 418/35–38; 123/241, 245
See application file for complete search history.

(56) References Cited

U.S. PATENT DOCUMENTS 2,155,249 A * 4/1939 Bancroft ..... 418/37
2,413,589 A * 12/1946 Snyder ..... 418/36
2,413,590 A * 12/1946 Snyder ..... 418/151
2,657,676 A * 11/1953 Mallinckrodt ..... 418/35
2,847,876 A * 8/1958 Willard ..... 475/152
2,943,785 A * 7/1960 Mallinckrodt ..... 417/348
3,221,716 A * 12/1965 Careddu ..... 418/36
3,301,193 A * 1/1967 Moore ..... 418/36
3,381,669 A * 5/1968 Tschudi ..... 418/38
3,493,066 A * 2/1970 Dooley ..... 180/165
3,645,239 A * 2/1972 Cena ..... 123/245
3,822,971 A * 7/1974 Chahrouri ..... 418/36
3,890,939 A * 6/1975 McIntosh ..... 418/36
3,981,638 A * 9/1976 Hutterer ..... 418/34
3,990,405 A * 11/1976 Kecik ..... 123/219
4,026,249 A * 5/1977 Larrea ..... 123/245
4,072,447 A * 2/1978 Gaspar ..... 418/36
4,194,871 A * 3/1980 Studenroth ..... 418/38

(Continued)

FOREIGN PATENT DOCUMENTS

DE 3727437 A1 * 3/1989

*Primary Examiner*—Thomas E Denion
*Assistant Examiner*—Mary A Davis
(74) *Attorney, Agent, or Firm*—Kunzler & McKenzie

(57) ABSTRACT

A gear set is disclosed having a guide, such as a cam, engaging the output shaft of the gear shaft and being indexed thereby. The guide drives one or more followers which in turn drive one or more interfaces of a differential gear set. The output shaft may be driven by a third interface of the differential gear set. The followers may likewise engage piston assemblies in order to control the piston assemblies during execution of a process such as a four stroke combustion process, or other process involving compression or expansion of a gas. The piston assemblies are enclosed within a housing defining an annular chamber, such as a toroid. Apertures formed in the housing allow exhaust gases to leave and air to be taken in. In one embodiment, a hyper expansion port is formed in the housing to release a portion of the air during the compression stroke in order to decrease the pressure of combustion gases.

28 Claims, 16 Drawing Sheets

U.S. PATENT DOCUMENTS 4,212,271 A * 7/1980 Rigterink ..... 123/43 B
4,531,379 A * 7/1985 Diefenthaler, Jr. ..... 123/DIG. 8
5,138,994 A * 8/1992 Maday ..... 123/248
5,199,391 A * 4/1993 Kovalenko ..... 418/35
5,381,766 A * 1/1995 Sakita ..... 123/245
5,501,182 A * 3/1996 Kull et al. ..... 418/36
5,645,027 A * 7/1997 Esmailzadeh ..... 123/245
6,006,519 A * 12/1999 Hormell, Jr. ..... 418/61.2
6,289,867 B1 * 9/2001 Free ..... 123/245
6,501,190 B1 * 12/2002 Seguchi et al. ..... 290/46
6,651,433 B1 * 11/2003 George, Jr. ..... 60/618
6,668,787 B2 * 12/2003 Masters ..... 123/245

* cited by examiner

DIFFERENTIAL WITH GUIDED FEEDBACK CONTROL FOR ROTARY OPPOSED-PISTON ENGINE

CROSS-REFERENCES TO RELATED APPLICATIONS

This application claims the benefit of U.S. Provisional Patent Application No. 60/670,567 entitled "DIFFERENTIAL WITH GUIDED FEEDBACK CONTROL FOR ROTARY OPPOSED-PISTON ENGINE" and filed on Apr. 12, 2005 for Dan K. McCoin and Mark D. McCoin, which is incorporated herein by reference.

BACKGROUND OF THE INVENTION

1. Field of the Invention

This invention relates generally to rotary engines and more particularly to rotary opposed-piston engines.

2. Description of the Related Art

The vast majority of internal combustion engines currently in use are reciprocating engines in which a piston moves up and down within a cylinder. The linear motion of the piston is translated into rotary motion by a crankshaft connected to the piston by a piston rod. In a typical engine, due to the large forces involved, the coupling between the crankshaft and the piston rod and between the piston and the piston rod, is a simple journal bearing. Accordingly, significant friction is introduced when converting the reciprocating motion of the piston to rotary motion. Furthermore, the power output on the crankshaft is not constant. As the piston drives the crankshaft, the crankshaft rotates and changes the effective length of the lever arm between the piston and the crankshaft.

Current internal combustion engines further require complicated valving mechanisms in order to introduce fuel and air into the cylinder and to release exhaust gases. Typically such mechanisms involve spring loaded valves that are biased toward the closed position. Cams, driven by the crankshaft open and close the valves at appropriate times by pushing against valve stems attached to the valves. The contact between the cam and the valve stems is typically a sliding contact introducing a great deal of friction just to open the valve.

Rotary engines eliminate many of these problems. In one type of rotary engine, the pistons move within a donut shaped chamber, or toroid, and are attached to an output shaft at the center of the toroid. The piston moves along an arcuate path, defined by the toroidal chamber, directly causing the output shaft to rotate. Accordingly, no translation from reciprocating to rotary motion is required.

The complicated valving systems of the reciprocating engine may be replaced in a rotary engine by simple apertures in the toroidal chamber. As the pistons move along the toroidal chamber, they move past the apertures drawing in air and expelling exhaust. A sealed combustion chamber is achieved by simply combusting the fuel air mixture in a portion of the toroidal chamber in which no apertures are formed.

What is currently lacking in the art is a practical rotary engine. Prior attempts have not been commercially viable and do not overcome critical challenges. The primary obstacle to achieving a practical rotary engine lies in the shape of the chamber itself. In a reciprocating engine a combustion chamber is defined by the top surface of the cylinder, the wall of the cylinder, and the piston. The combustion chamber traps expanding gases, forcing the piston to move. In a rotary engine, one must find a way to define a combustion chamber within a toroidal chamber with no top surface, as in a cylinder.

Two possible solutions to this problem exist. First, one may place a fixed barrier within the toroidal chamber. Accordingly, the piston, the barrier, and the walls of the toroid define a combustion chamber. Second, one may use two opposed pistons, fixing a first piston and allowing a second piston to move, then fixing the second piston and allowing the first piston to move. Thus a combustion chamber is defined by the two pistons and the walls of the toroid.

Defining a fixed barrier is problematic because the piston must constantly change direction once it reaches the barrier. Opposed pistons do not have this problem, in as much as both pistons can be allowed to move within the toroid. However, both types of rotary engine must have some mechanism to control the movement of the piston, whether to reverse direction when needed or to fix the position of the piston in order to define a combustion chamber. Both types must also translate the discontinuous velocity of a piston into a substantially constant rotation of an output shaft. Prior systems provide no adequate means to control the pistons providing a smooth output at high output torques.

Some designs, for example, use mechanisms to obstruct the movement of the piston in order to fix its position. In one system, stop pins are moved into place to stop the piston. However, such systems simply obstruct the motion of the piston. Accordingly, at high angular velocities the piston will repeatedly strike the stopping mechanism at high speeds causing premature breakage. Prior designs also provide no blending of motion to give a smooth output torque. Motion of the piston in prior systems is simply rectified to the correct rotational direction but is not controlled to provide a smooth angular velocity output. In addition to providing a low quality output, such systems are subject to a great deal of mechanical shock, clatter, wear, and breakage, regardless of load, resulting in a very short useful life.

Accordingly, it would be an advancement in the art to provide a rotary opposed-piston engine providing a substantially constant output. Such a system should control the motion of the pistons to define a combustion chamber while reducing mechanical shock to the components thereof.

SUMMARY OF THE INVENTION

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

A system is disclosed for converting power between two power devices, one device continuous and the other intermittent. Power may flow from the continuous to the intermittent device, or from the intermittent to the continuous device. In one embodiment, the system is a main power conduit—for example a shaft and a flywheel—and the system includes a gear case to allow smooth power transfer. The gear case may include a differential which allows the power elements on the intermittent side to move at variable rates. The differential may be, for example, an exploded planetary gear set or an epicyclic planetary gear set.

The system may also include a locking device which controls the velocity and position of the power elements of the intermittent side. The locking device may be a follower arm corresponding to each power element, where the position of the follower arm correlates to the position of the corresponding power element. The locking device may further include a cam configured to guide each of the follower arms and thereby control the position of each power element.

A rotary engine is also disclosed. The rotary engine may comprise a plurality of pistons secured to a hub, and a housing enclosing the pistons. The housing and piston hubs may define a toriodal chamber within which the pistons rotate. The engine may have a differential and a locking device to provide a smooth power output to a main shaft from the intermittent power inputs of the pistons operating in a combustion cycle.

The rotary engine may be, for example, a pneumatic motor, a spark ignited engine, or a diesel cycle engine. The rotary engine may also be a heat engine such as, for example, a steam engine. In one embodiment, the rotary engine can be configured to perform a constant volume combustion cycle for at least a portion of the combustion event, allowing the engine to achieve greater efficiencies through higher cylinder pressures than conventional engines. Also, the engine can be configured to operate on a hyper-expansion cycle, allowing the engine to achieve greater efficiencies than in conventional engines. The rotary engine may be configured with scalloped pistons to make the combustion chambers of the engine more favorable for combustion. The engine may also be configured to start without an external starting device through manipulation of the hyper-expansion capability.

An energy conversion device is also disclosed. The energy conversion device may be configured to run on an Alpha-cycle which provides power to a main shaft, or on a Beta-cycle which takes power from a main shaft. The energy conversion device may contain a plurality of compression-expansion chambers. The device may be configured to take a high energy fluid and convert it to a low energy fluid thereby supplying power to the main shaft, or to take a low energy fluid and convert it to a high energy fluid, while taking power from the main shaft. The energy conversion device can thereby act as a pump, air compressor, combustion engine, heat engine, or any other device consistent with the operations described. The energy conversion devices may be added to the same main shaft. The devices can therefore act as stages in supplying power to the main shaft, or one energy conversion device may be configured to supply power to another energy conversion device through the main shaft.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

Figure 1A:
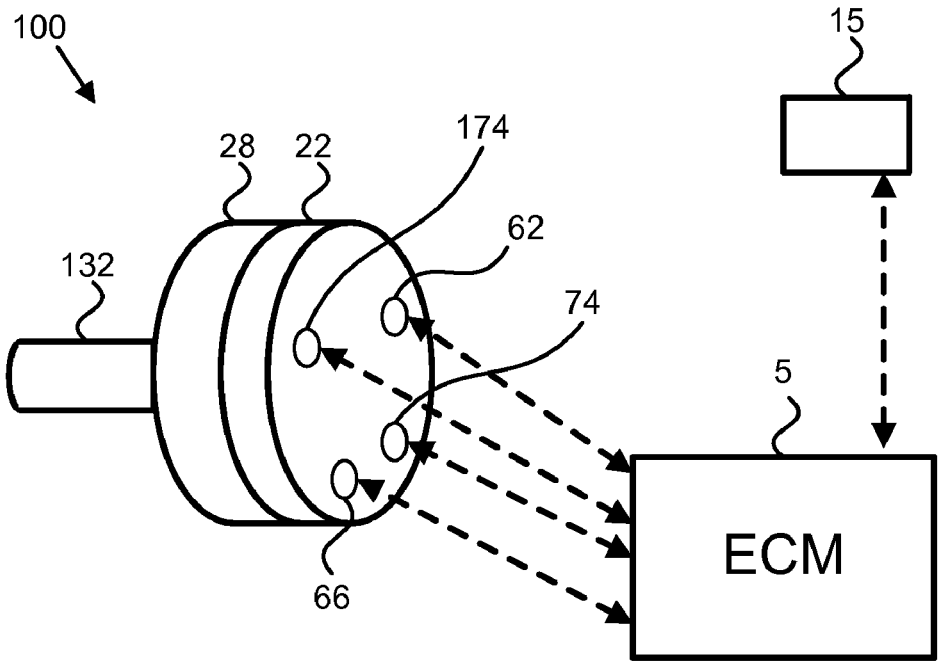
FIG. 1A illustrates one embodiment of a system for converting intermittent power inputs to a constant power output in accordance with the present invention.

FIG. 1 illustrates one embodiment of a system 100 for converting power, with intermittent power on one side of the system 100 and continuous power on the other. The system 100 may comprise a first power device (not shown) coupled to a main power conduit. The first power device may be a continuous power device, which means the power device may supply continuous power to the main power conduit, or it may be configured to take continuous power from the main power conduit. The main power conduit may comprise a flywheel and a main shaft 132. The main power conduit 132 may be coupled to a second power device 22, which may be an intermittent power device. The second power device 22 may supply intermittent power to the main power conduit 132, or it may use the power from the main power conduit 132 intermittently.

In one embodiment, the second power device 22 is an internal combustion engine, and intermittently supplies power to the main power conduit 132. In this manner, the power may flow from the second power device 22 to the first power device. In another embodiment, the second power device 22 is a pump or compressor, and takes power from the main power conduit 132 intermittently to compress gas and supply the gas through a port 62, 66, 74, 174 to some other device. In this manner, power may flow from the first power device to the second power device 22, and the second power device 22 may output power as an intermittent stream of compressed gas.

The system 100 may further include a gear case 28 coupled to the main power conduit. The gear case 28 may transfer power between the main power conduit 132 and the second power device 22. As indicated above, the power can transfer through the gear case 28 in either direction—either from the main power conduit 132 to the second power device 22, or from the second power device 22 to the main power conduit 132. The gear case 28 thereby transfers power between the first power device and the second power device.

The gear case 28 may include a differential. The differential may be configured to allow multiple power elements within the second power device 22 to rotate at a variable rate. Rotating at a variable rate in this embodiment may mean allowing power elements within the second power device 22 to change rotational speeds relative to each other, including allowing power elements to stop, while allowing the main power conduit 132 to maintain a smooth continuous rotation. The differential may comprise an exploded planetary gear set, or an epicyclic planetary gear set.

The gear case 28 may further include a locking device. The locking device may be configured to control the relative velocity and position of a plurality of power elements within the power device 22. Dividing the second power device 22 into power elements allows the second power device 22 to have multiple intermittent contributors to the supply or receipt of power. In one example, the power elements of the second power device 22 may be a plurality of piston assemblies. Each piston assembly may comprise one or more pistons, and the piston assemblies may be within the housing 22. In one embodiment, the locking device may comprise a follower for each power element. The position of each follower may correlate to the position of the corresponding power element. The locking device may further comprise a cam configured to guide each of the followers, thereby controlling the position of each power element.

The system 100 may further comprise an electronic control module 5 (ECM) configured to communicate with various sensors and actuators in the system 100. In one embodiment, the ECM 5 may communicate with an ambient air pressure sensor 15 configured to provide a signal readable by the ECM 5 to indicate the current ambient air pressure.

The system 100 may further comprise a hyper expansion port 174. A hyper expansion port 174 is a port that allows fluid to escape a combustion chamber during a time when a normal engine cycle would begin to compress air. An engine operating in a hyper expansion mode pulls work from combusted fluid until the fluid is down to a pressure at or near ambient air pressure. This allows the engine to derive a little more work out of the combustion event rather than just venting high pressure gas. A conventional engine cannot operate in a hyper expansion mode because of limitations in piston crank angles where power can be effectively applied to the crankshaft, and because hyper expansion reduces the power density of the engine. A rotary engine can be configured to derive work from the piston at any time, and naturally has a high power density, so hyper expansion can be performed in a rotary engine.

The ECM 5 may be configured to modulate or manipulate the hyper expansion port 174 in response to the ambient air pressure sensor 15 such that a constant fluid mass remains in a combustion chamber within the housing 22 at the end of a fluid intake operating phase through a wide range of ambient operating pressures. The ECM 5 may thereby operate the system 100 as a rotary combustion engine with relatively constant power available at high altitudes. For example, the system 100 may comprise a rotary engine on an aircraft, allowing the engine to have about the same power available at flying altitudes as at sea level.

The ECM 5 may be configured in one embodiment to manipulate an intake port 66, an exhaust port 74, and a combustion initiation device 62. The combustion initiation device 62 may comprise a fuel injector, a spark initiator, or both. Additionally, there may be multiple combustion initiation devices 62 at various points on the housing 22. For example, there may be a fuel injector 62 configured to inject fuel during an air intake event, and there may be a spark initiator 62 configured to initiate combustion at a desired time in the operation cycle of an engine. In another example, there may be a fuel injector 62 configured to inject fuel at a desired time in the operation cycle of an engine where the fluid in the combustion chamber is hot enough to ignite the fuel directly.

In one embodiment, the ECM 5 may be configured to operate the system 100 as a hyper-expansion engine, and to manipulate the intake port 66, exhaust port 74, and/or combustion initiation device 62 in a manner such that the engine can be started without an external starting mechanism. Even where the engine is not normally operated as a hyper-expansion engine, the ECM 5 can be further configured to manipulate the hyper-expansion port 174 to start without an external starting mechanism. This starting mechanism works in an engine capable of hyper-expansion because the forces generated in combusting the air in a cylinder at ambient pressure can overcome the slight compression performed during a hyper-expansion cycle.

Figure 1B:
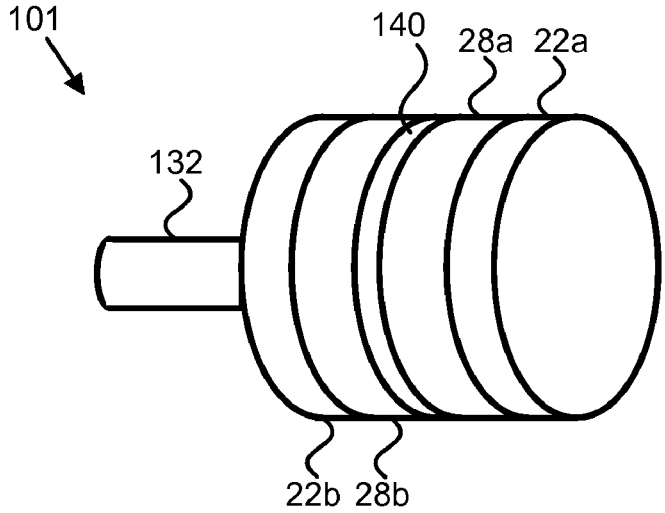
FIG. 1B illustrates one embodiment of an energy conversion device in accordance with the present invention.

FIG. 1B illustrates one embodiment of a system 101 comprising an energy conversion device 22*b*/28*b* in accordance with the present invention. The system 101 may further comprise a second energy conversion device 22*a*/28*a*, and the first and second energy conversion devices 22*a*/28*a*-22*b*/28*b* may share a flywheel 140. The system 101 may comprise a power conduit 132 which may be a main shaft 132 coupled to the flywheel 140. Each energy conversion device 22*a*/28*a*-22*b*/28*b* may comprise at least one expansion-compression chamber configured to sequentially compress and expand.

Each energy conversion device 22*a*/28*a*-22*b*/28*b* may be configured to receive a high energy fluid before an expansion phase of the expansion-compression chamber, to allow expansion of the high energy fluid and transfer power to the main shaft 132, then to release the residual low energy fluid from the expansion-compression chamber. This is referred to herein as an Alpha cycle. An energy conversion device 22*a*/28*a*-22*b*/28*b* may intermittently take energy from the main shaft 132 during an Alpha cycle, for example to compress air before a fuel injection event, while the Alpha cycle nets a transfer of energy to the main shaft 132.

Each energy conversion device 22*a*/28*a*-22*b*/28*b* may be configured to receive a low energy fluid before a compression phase of the expansion-compression chamber, to compress the low energy fluid by taking power from the main shaft 132, then to release the residual high energy fluid from the expansion-compression chamber. This is referred to herein as a Beta cycle.

The high energy fluid may be compressed air, steam, or a fluid with high chemical potential energy like hydrogen, diesel fuel, or gasoline. The low energy fluid may be a fluid that has expended a portion of the stored chemical or thermal energy in the fluid. Therefore, the energy conversion device may be, without limitation, an internal combustion engine, a heat engine, a steam engine, a pneumatic motor, or the like. The energy conversion device may also operate as an air compressor or a fluid pump.

In one embodiment, each energy conversion device 22*a*/28*a*-22*b*/28*b* operates on an Alpha cycle and contributes net energy to the power conduit 132. In another embodiment, one energy conversion device 22*a*/28*a* operates on the Alpha cycle and contributes net energy to the power conduit 132, while the other energy conversion device 22*b*/28*b* operates on the Beta cycle and receives net energy from the power conduit 132.

Figure 2:
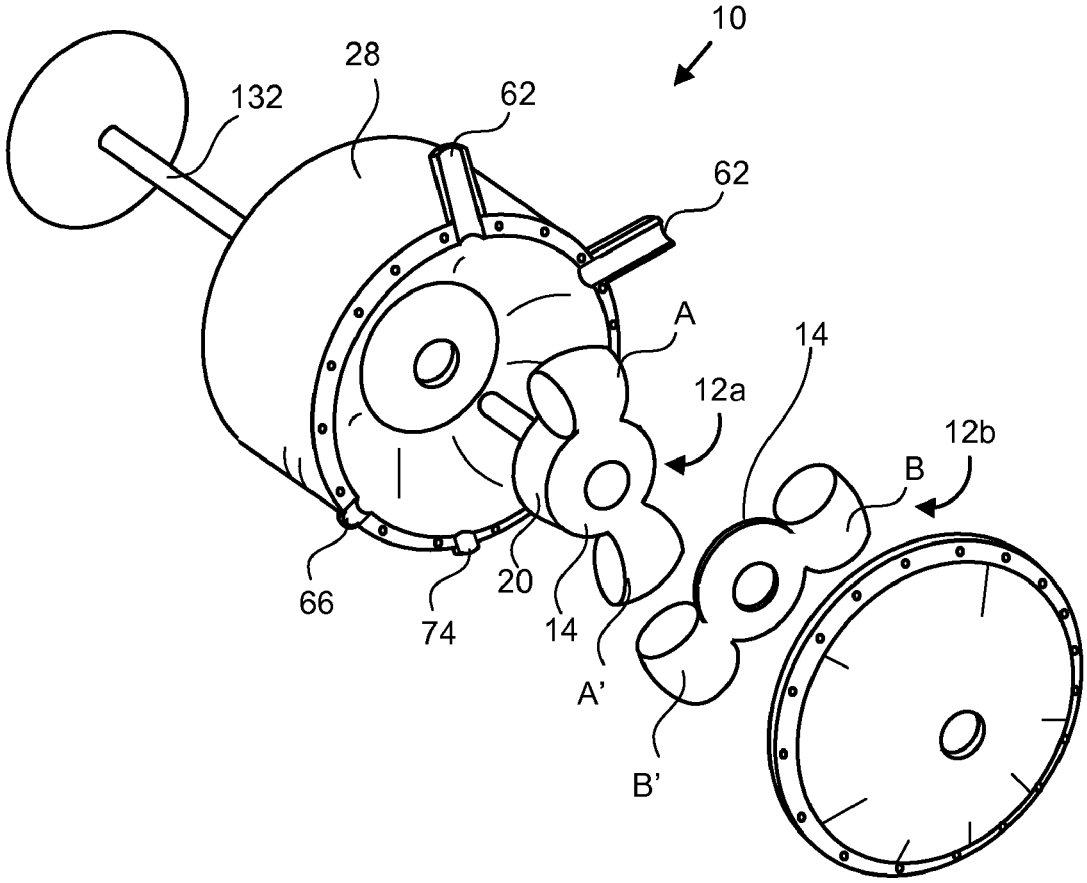
FIG. 2 is an exploded perspective view of an energy conversion device in accordance with the present invention.

FIG. 2 is an exploded perspective view of an energy conversion device 10 in accordance with the present invention. The energy conversion device 10 may comprise a first piston A coupled to a first hub 14, and a second piston B coupled to a second hub 14. The piston A, counter-piston A', and hub 14 may be a first power input 12*a*, or a first piston assembly 12*a*. Likewise, the piston B, counter-piston B', and hub 14 may be a second power input 12*b*, or a second piston assembly 12*b*. For the sake of clarity, the piston and counter piston of piston assembly 12*a* shall be referred to as A and A', respectively. The piston and counter piston of piston assembly 12*b* shall be referred to as B and B', respectively.

The energy conversion device 10 may further comprise a power conduit 132, a gear case 28, one or more combustion initiation devices 62, an intake port 66, and an exhaust port 74. The energy conversion device 10 may further comprise a hyper expansion port 174 (not shown).

Figure 3:
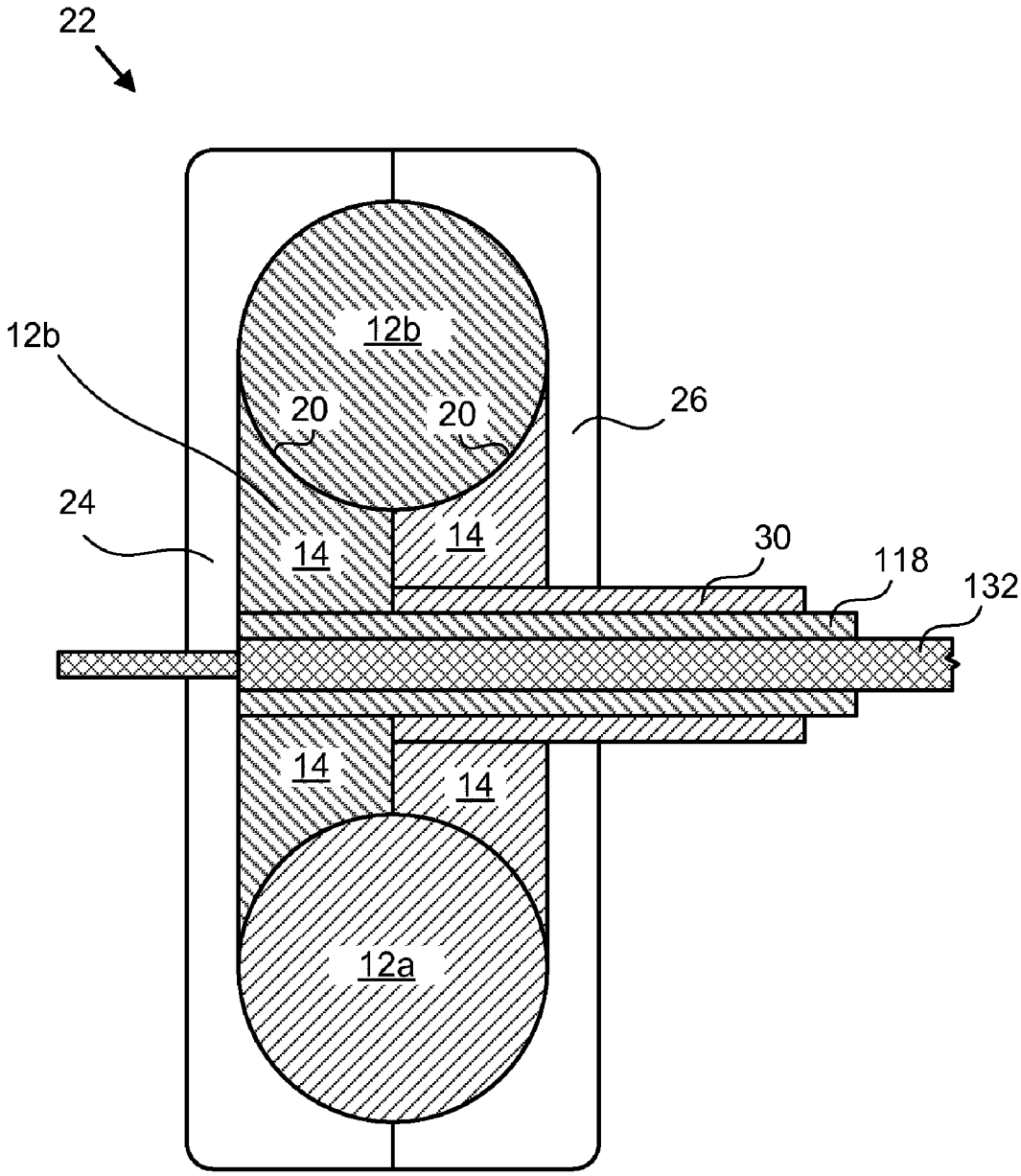
FIG. 3 is a cutaway side view of a housing and a piston assembly, in accordance with the present invention.

FIG. 3 is a cutaway side view of a housing 22 and piston assemblies 12*a*, 12*b*. The hub 14 may include a groove 20, which together with a housing 22 forms a toroidal chamber, with a circular cross-section in one embodiment, within which the pistons A,A',B,B' move. Alternatively, the groove 20 and housing 22 may form chambers having other shapes, such as a toroid having a square, elliptical, or rectangular cross-section. As used herein, a toroidal chamber describes the chamber required to accommodate a piston of any shape rotating about the hub 14. The housing 22 may have a cover 24 and a base 26. The base 26 may secure to a gear box 28 housing gears controlling the movement of the piston assemblies 12*a*,12*b*. A cover 24 may secure to the base 26 by means of bolts or other securement means. In some embodiments, the base 26 may be integrally or monolithically formed with the gear case 28, or a portion of the gear case 28.

Piston assembly 12*a* may secure to a shaft 30 extending into the gear box 28. Piston assembly 12*b* may secure to a shaft 118. In some embodiments, the shaft 30 is hollow and the shaft 118 extends therethrough. In others, the shaft 118 is hollow and the shaft 30 extends therethrough. In some embodiments, both shafts 30, 118 are hollow and a power output shaft 132 may extend therethrough in order to exchange power with the energy conversion device 10.

Figure 4A:
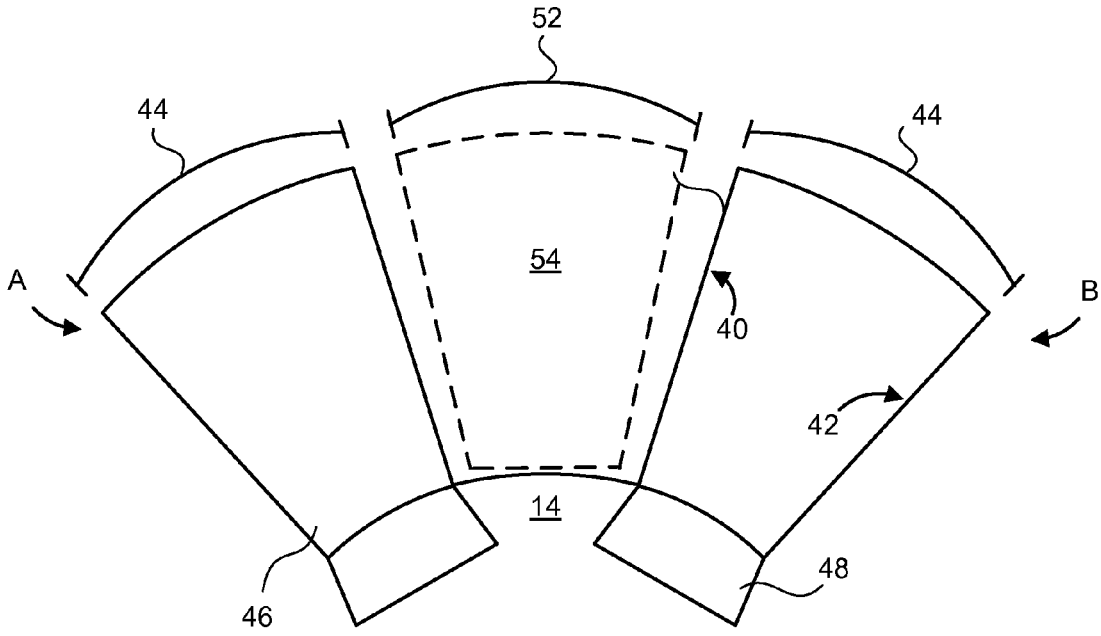
FIG. 4A is a side view of opposing pistons forming a compression-expansion chamber in accordance with the present invention.

FIG. 4A illustrates a side view of opposing pistons A,B and a resulting combustion chamber 54. Each piston A, A', B, B' may include two faces 40, 42 separated by an angle 44. The angle 44 may be chosen to maximize the compression ratio of the engine 10 while providing a sufficiently strong base 46. A key 48 may be formed monolithically with the piston A, A', B, B' and fit into a corresponding slot in the hub 14. A set screw or like fastener may retain the key 48 within the hub 14. Alternatively, a piston A, A', B, B' may be fastened integrally or monolithically to the hub 14.

Figure 4B:
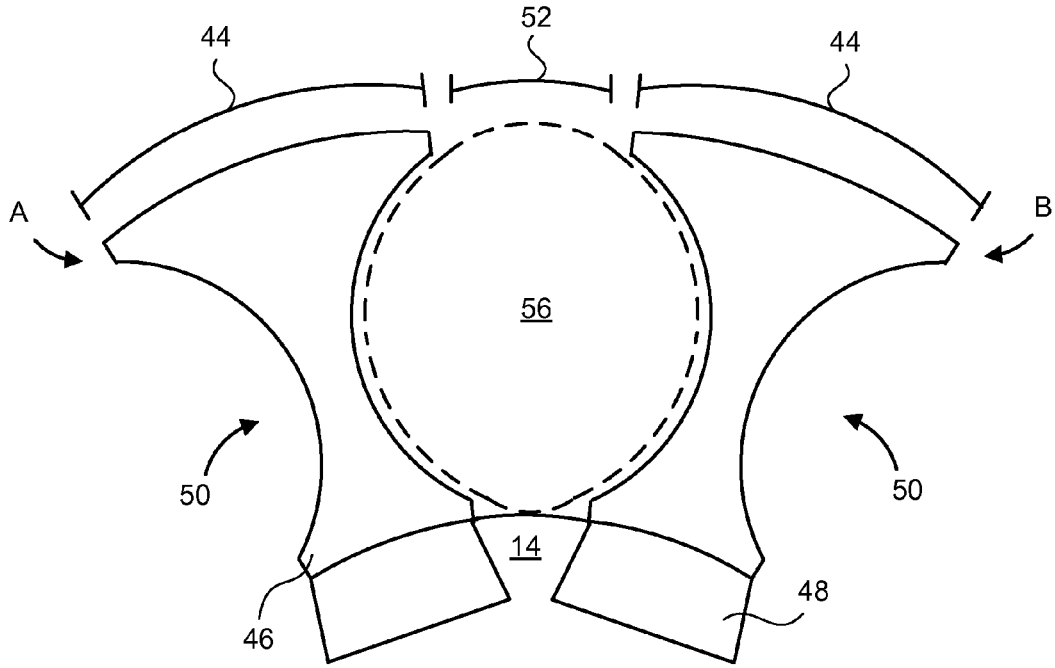
FIG. 4B is a side view of opposing pistons with scalloped faces forming a compression-expansion chamber in accordance with the present invention.

Referring to FIG. 4B, in some embodiments, the faces 40,42 have scallops 50 formed thereon in order to improve characteristics of the combustion chamber. In a combustion chamber, the air-fuel mixture near the walls of the chamber is cooler than the air in the center of the chamber. Accordingly, the fuel near the walls of the chamber may not fully combust, causing efficiency loss and increased pollution. Further, heat transfer from the walls to the environment reduces the efficiency of combustion. To minimize this effect, the surface area to volume ratio must be reduced. The shape having the largest surface area to volume ratio is the sphere. By forming scallops 50 in the faces 40,42 of the pistons A,A',B,B', a combustion chamber approaching spherical is produced. Compare the combustion chamber 54 in FIG. 4A formed by flat piston faces 40,42 with the combustion chamber 56. Note that any degree of scalloping improves the shape of the combustion chamber, and scalloping as used here is intended to cover any incremental changes beyond a flat piston face.

Scalloping the pistons A,A',B,B' may also enable the angle 44 and base 46 of the piston A,A',B,B' to be made larger. Where the faces 40,42 are flat, the separation between the faces 40,42 must be sufficiently large to define a suitable combustion chamber during the combustion stroke. However, where the faces 40,42 are scalloped the angular separation between the pistons A,A',B,B' can be made smaller. Accordingly, the angle 44 and base 46 of the pistons A,A',B,B' may be made larger ratio while still creating a combustion chamber having the correct volume.

Figure 5A:
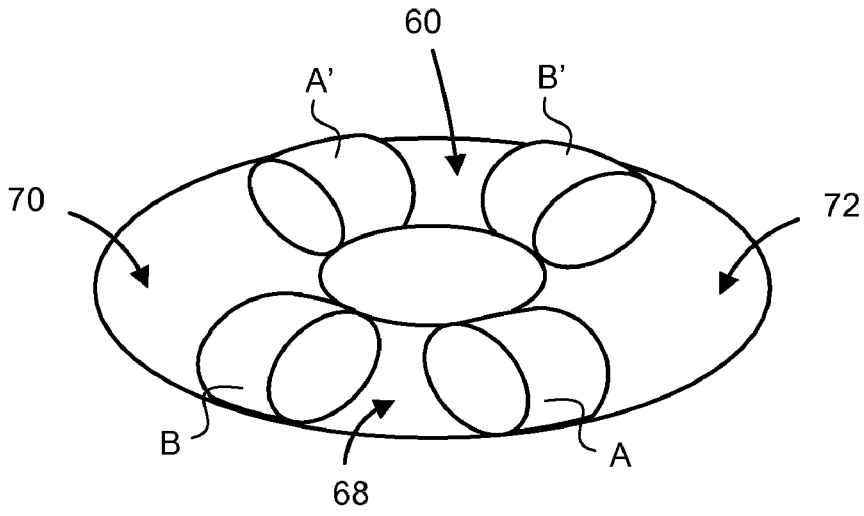
FIG. 5A is a schematic illustration of four compression-expansion chambers formed within a toroidal chamber in accordance with the present invention.

FIG. 5A is a schematic illustration of four combustion chambers 60, 72, 68, 70 formed within a toroidal chamber in accordance with the present invention. In the example, the chamber 72 has just experienced combustion and is ready to exhaust, chamber 68 has just exhausted and is ready to intake fresh air, chamber 70 is just completing the intake cycle and is ready to compress the air, and chamber 60 has just compressed air and is ready for the combustion cycle. Pistons A, A' are counter pistons, and are physically attached to the same hub 14 of piston assembly 12*a*. Likewise, Pistons B,B' are counterpistons and are physically attached to the same hub 14 of piston assembly 12*b*.

Figure 5B:
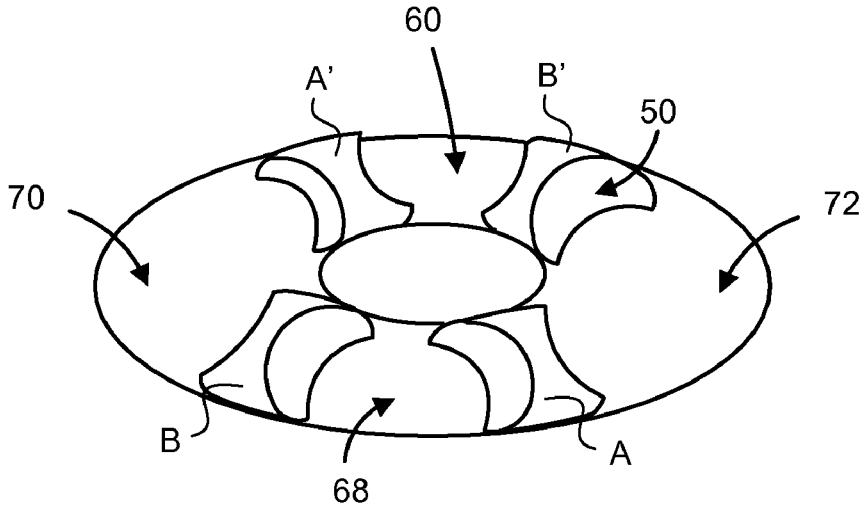
FIG. 5B is a schematic illustration of another embodiment with four compression-expansion chambers formed within a toroidal chamber in accordance with the present invention.

FIG. 5B is a schematic illustration of four combustion chambers 60, 73, 68, 70 formed within a toroidal chamber in accordance with the present invention. In the example, the pistons A,A',B,B' have scalloped faces 50, and the combustion chambers are in approximately the same relative positions as those in FIG. 5A.

Figure 6A:
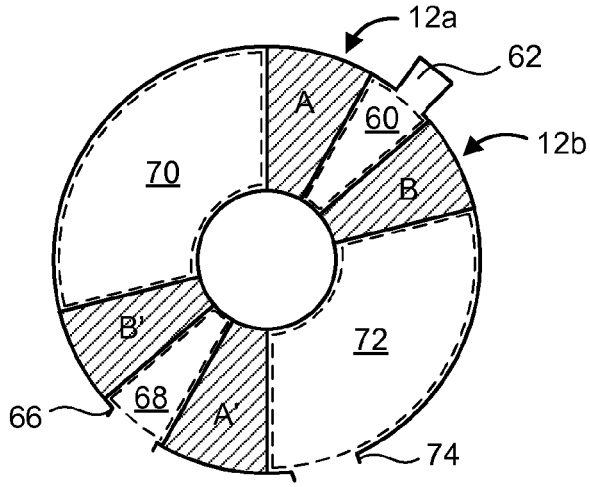
FIGS. 6A-6C are schematic illustrations illustrating the movement of piston assemblies executing a four-cycle combustion process.
Figure 6B:
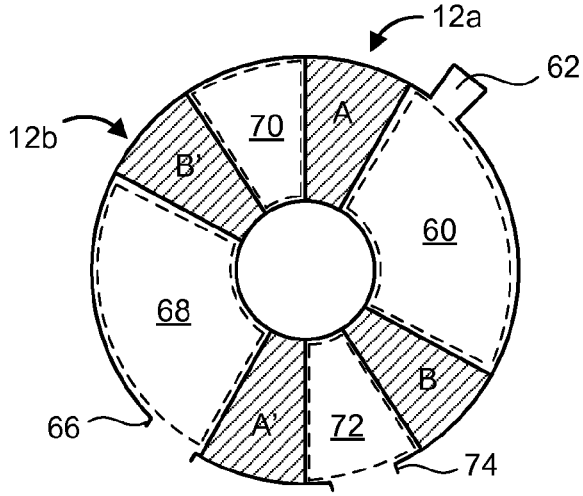
Figure 6C:
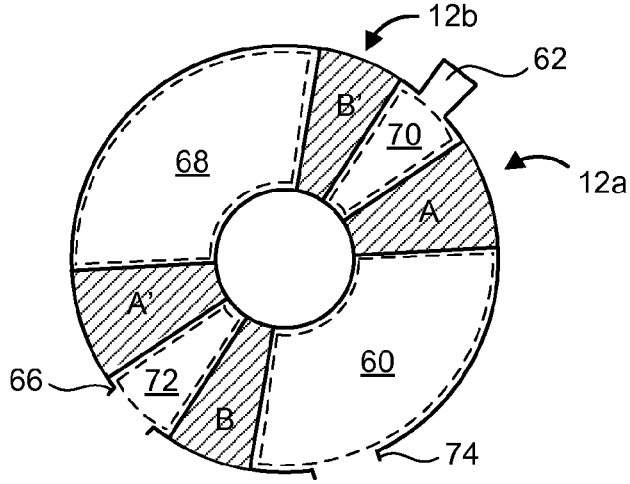

FIGS. 6A-6C illustrate one possible series of motions of the pistons A, A', B, B' accomplishing a four-stroke combustion process. Referring to FIG. 6A, the combustion stroke begins with piston assemblies 12*a*, 12*b* positioned as shown. Volume 60 typically contains compressed air. In some embodiments, fuel may be injected through combustion initiation device 62 as part of a diesel cycle or fuel injected four stroke cycle. Alternatively, a fuel air mixture may be taken in during the intake stroke discussed below, and the use of combustion initiation device 62 as a fuel injector may be unnecessary.

As the pistons reach the positions illustrated in 6A, combustion initiation device 62, for example a spark plug, may fire causing the fuel and air in the volume 60 to explode, driving piston B away from piston A. Driving piston B away from piston A simultaneously powers an intake stroke inasmuch as it causes piston B' to rotate toward piston A, thereby drawing air, or a fuel air mixture, through the intake port 66 into volume 68. The rotation of piston B' toward piston A also powers a compression stroke as the air, or fuel-air mixture, in volume 70 is compressed. An exhaust stroke likewise occurs simultaneously, as piston B is toward piston A', expelling combustion gases from volume 72 through the exhaust port 74.

Referring to FIG. 6B, as piston B' approaches piston A, piston A slows and piston B' begins to accelerate. For a few degrees of rotation piston assemblies 12*a* and 12*b* may move at the same velocity. As the piston assemblies 12*a* and 12*b* approach the positions illustrated in 6C, the air in volume 70 is ignited and the cycle is repeated.

The engine 10 may be used to perform other processes such as the diesel cycle, compressing gas, or serving as a pneumatic motor. For example, in order to perform the diesel cycle, diesel fuel may be injected into volume 60 at the end of the compression stroke through a combustion initiation device 62 comprising a fuel injector. In order to function as an air compressor, a port may be added such that at the point where ignition occurs in the four-stroke cycle, the air is released into a holding tank. In order to achieve a pneumatic motor, a port may be added such that at the point where combustion occurs in the four-stroke cycle, compressed gas is allowed to enter the chamber and drive the piston.

Figure 7:
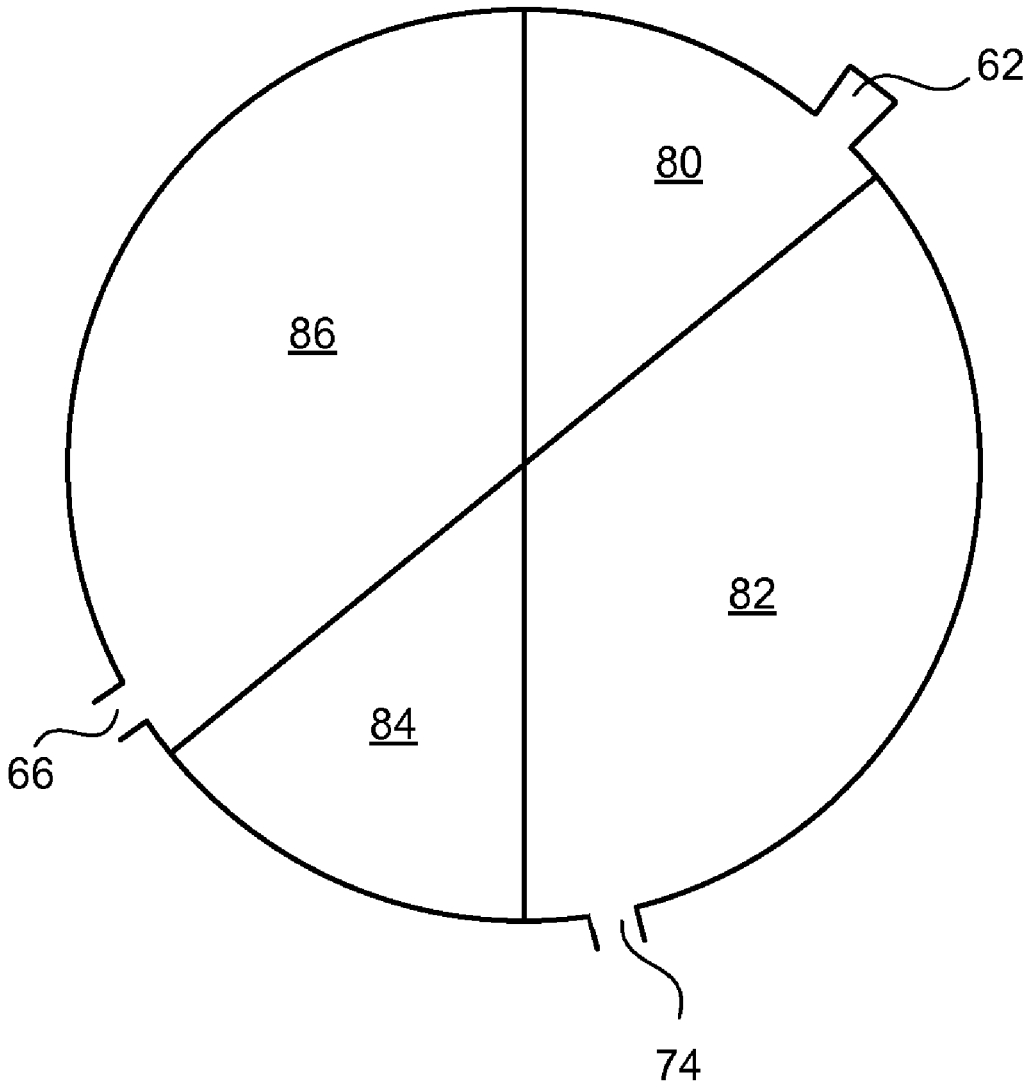
FIG. 7 is a schematic representation of the angular regions corresponding to stroke and dwell movements of the piston assemblies, in accordance with the present invention.

FIG. 7 illustrates the angular regions corresponding to each part of one embodiment of the four-stroke cycle. The angular regions may be described as a dwell region 80, a combustion/exhaust region 82, a second dwell region 84, and an intake/compression region 86. The dwell portion 80, 84 corresponds to the portion of the cycle where the piston assemblies 12*a*, 12*b* move in unison, typically at constant velocity. The dwell portion of the cycle may serve to position the piston assemblies 12*a*, 12*b* in preparation for the next cycle. In some embodiments, the dwell portions 80, 84 may also enable a "burn dwell" in which the fuel is ignited near the beginning of the dwell portion 80, thereby causing a constant volume combustion event as the piston assemblies 12*a*, 12*b* move through the dwell region 80, 84.

Figure 8:
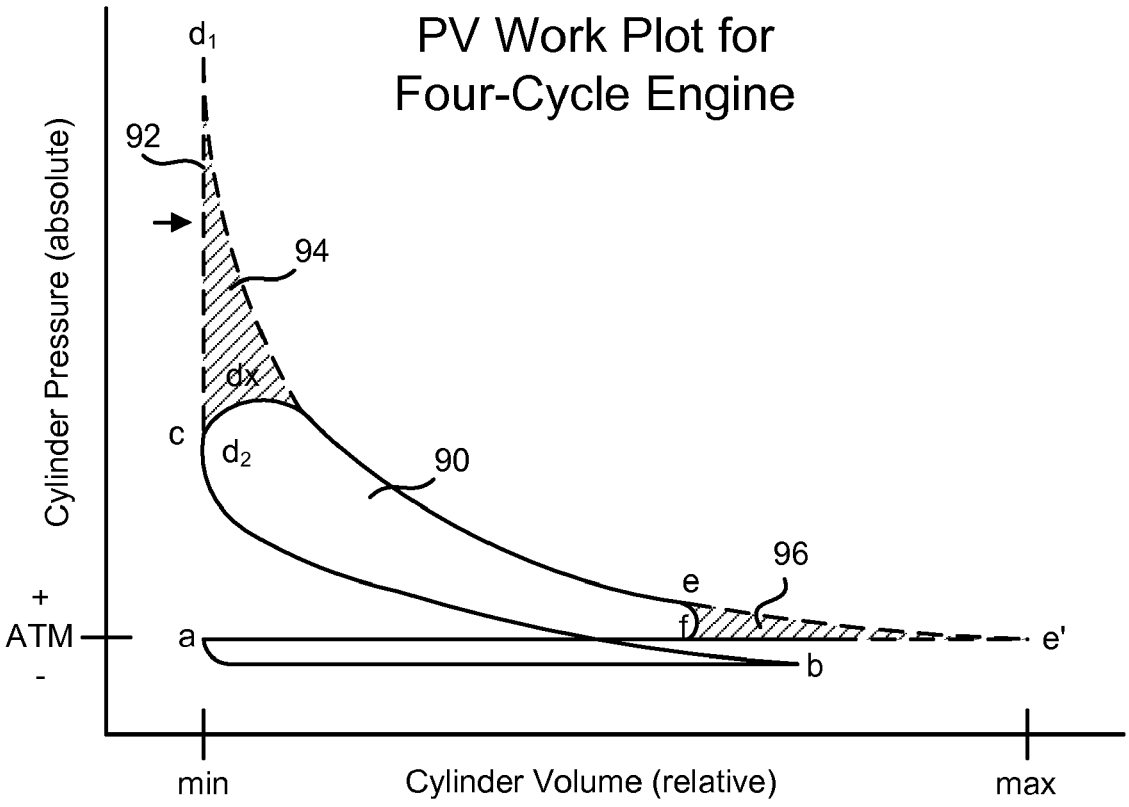
FIG. 8 is a pressure-volume plot of a conventional engine and a rotary opposed-piston engine, in accordance with the present invention

Referring to FIG. 8, a pressure-volume (PV) plot of the four-stroke cycle illustrates the improved thermodynamic efficiency resulting from a burn dwell. Those of skill in the art will recognize that the area of the PV plot circumnavigated by the engine 10 during a combustion event correlates to the amount of work extracted from the combustion event. Plot area 90 represents the combustion cycle of a conventional four-stroke engine. Plot 92 represents the PV trajectory for an engine performing a constant volume burn dwell combustion event. The plot area 94 represents the opportunity for additional work recovery from an engine utilizing a burn dwell. A particular embodiment of an engine 10 using a burn dwell may utilize some or all of the plot area 94 depending upon the maximum allowable pressures, combustion rates, heat losses to the environment, and other variables understood by one of skill in the art.

Additional efficiency gains may be captured by using hyper-expansion (expansion of combustion gases to a volume larger than that of the intake air). Plot area 96 represents the potential additional work that can be captured by allowing the combustion gases to expand to atmospheric pressure. During the combustion process, the amount of gas in the combustion chamber increases. The air and gasoline that went into the combustion cycle is converted into a much larger amount of inert gases, left over oxygen, and combustion byproducts such as $CO_2$. Combustion gases also have increased pressure due to their higher temperature as a result of combustion. Accordingly, in order for the combustion gases to expand until they reach atmospheric pressure, the combustion chamber must expand to a volume significantly larger than the volume of the air going into the combustion process. In a conventional engine, because the cylinder has a fixed size, combustion gases cannot expand further and perform more useful work. Accordingly, exhaust gases are simply released and the potential work is wasted.

Figure 9:
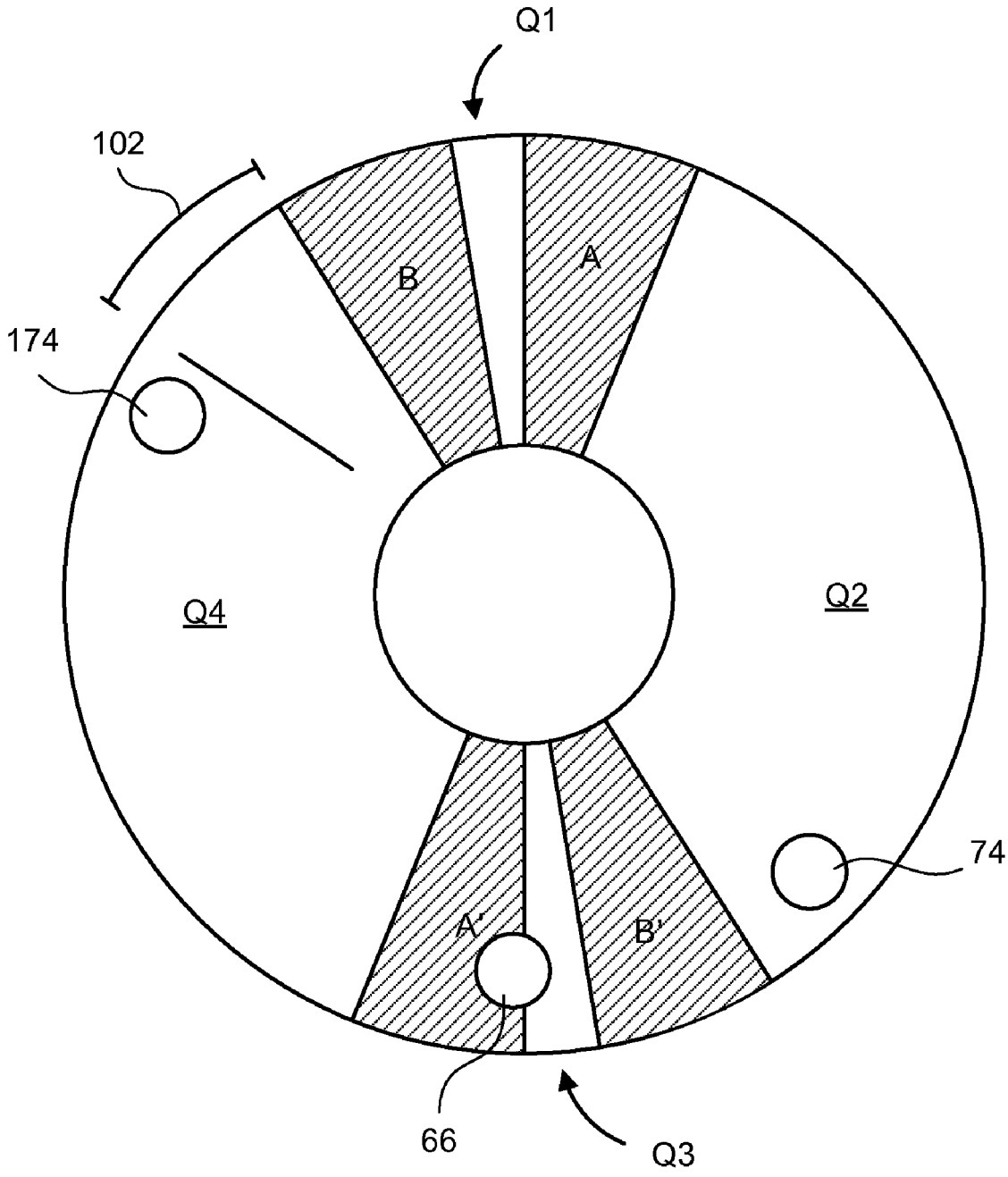
FIG. 9 is a schematic representation of a chamber having a hyper-expansion port, in accordance with the present invention.

Referring to FIG. 9, in one embodiment of an engine 10 hyper-expansion is made possible by decreasing the volume of air taken in during the intake stroke. A hyper-expansion port 174 is provided such that as a piston moves through the compression stroke, air is allowed to escape through the hyper-expansion port 174. The released air may be vented to the exhaust to assist in pumping exhaust air out. Once the piston moves across the port 174, captured air is compressed for the remaining portion 102 of the compression stroke. In this manner, the volume of combustion gases is also reduced and achieves a lower pressure at the end of the combustion stroke.

The hyper-expansion port 174 need not be a separate port and could be shared with the intake port 66. For example, hyper-expansion can be achieved by the ECM 5 modulating the intake port 66 to achieve the same effect by closing the intake port 66 before the intake cycle would otherwise be complete. All of these variations of the hyper expansion cycle are considered within the scope of the present invention.

Although hyper expansion improves efficiency, it also reduces power output. The compression ratio of the engine is effectively reduced due to the decrease in the volume of air compressed during the compression stroke. Accordingly, in some embodiments, the hyper-expansion port 174 may be opened and closed according to the power demanded at a given moment. For example, in an automobile, when moving at constant velocity the port 174 may be opened to increase engine efficiency. When the automobile is accelerating, the port 174 may be closed to increase power.

In aeronautical applications, for example, the port 174 may be opened or closed to compensate for the decrease in pressure of intake air with increasing altitude. For example, when an aircraft flies in the rarified air of the upper atmosphere, the port 174 may be closed to increase the amount of intake air. At lower altitudes, the port 174 may be opened inasmuch as the air pressure is greater.

In some embodiments, a pressure sensor may control opening and closing of the port 174 such that a constant, or near constant compression ratio is achieved. For example, a pressure sensor in the toroidal chamber may detect that the compression ratio is lower than some value and close the port 174. Alternatively, a port 174 may be manually operated, such that when the driver of a vehicle needs more power the port 174 can be closed. Similarly, an ambient air pressure sensor, mass air flow sensor, and other methods of determining the air mass in the cylinder can be used to control the hyper-expansion port 174.

Figure 10:
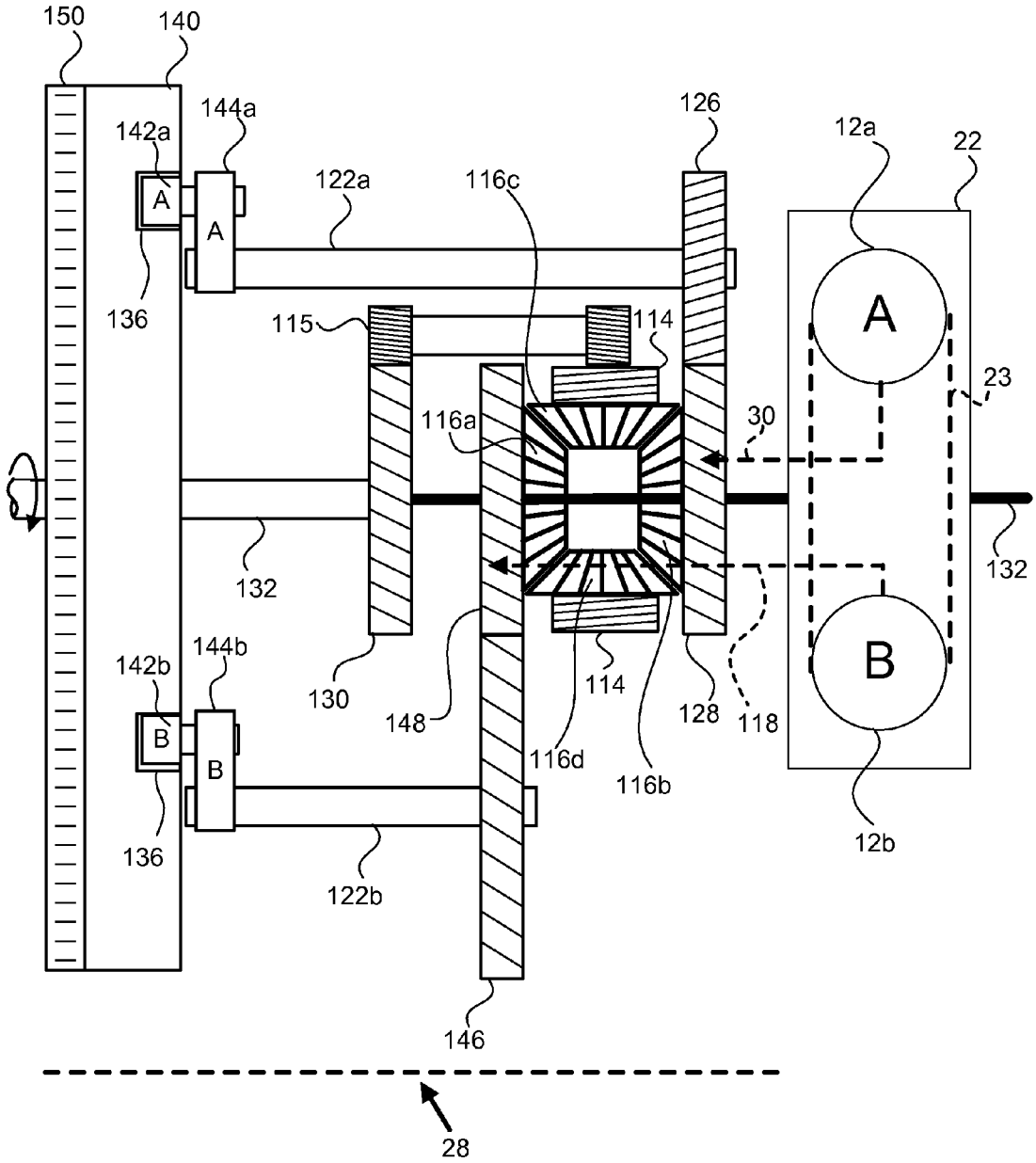
FIG. 10 is a schematic representation of a differential having exploded planetary gearing, in accordance with the present invention.

Referring to FIG. 10, a gear case 28 may contain a differential 116*a*-116*d* and a locking device. The differential 116*a*-116*d* may be configured to allow the power inputs 12*a*, 12*b* to rotate at variable rates. The differential 116*a*-116*d* shown in FIG. 10 comprises an exploded planetary gear set 116*a*-116*d*.

The locking device may be configured to control the relative velocity and position of the power inputs 12*a*,12*b*. The locking device may comprise a plurality of followers 142*a*, 142*b*, where each follower corresponds to one of the power inputs 12*a*,12*b*. The locking device may further comprise a cam 136 configured to guide each of the plurality of followers 142*a*, 142*b*. The followers 142*a*, 142*b* shown in FIG. 10 comprise cam followers coupled to a follower shaft 122*a*, 122*b*. The cam 136 may be a groove defining a closed path. The cam 136 may be a groove in the flywheel 140, wherein the position of the groove in the flywheel 140 fixes the corresponding positions of the follower arm 122*a*, 122*b*, follower coupling gear 126, 146, piston driving gear 128, 148, and therefore the piston 12*a*, 12*b*.

Power inputs 12*a*, 12*b* in FIG. 10 rotate within the toroidal chamber 23 as shown. Power inputs 12*a*,12*b* will not be at 180 degrees apart in an engine 10 with 4 pistons A,A',B,B' because the counter pistons are at 180 degrees. However, 12*a*,12*b* are shown at 180 degress in FIG. 10 for clarity.

The power input 12*a* operates in the example as follows. Power input 12*a* is coupled 30 to the piston driving gear 128 and differential gear 116*d*. The coupler 30 may comprise a hollow shaft 30 such that power input 12*a* directly drives the gears 128, 116*d*, and allows the main shaft 132 to pass therethrough. When power input 12*a* provides power and power input 12*b* is locked by the cam 136, power input 12*a* turns the differential gear 116*b*, causing a ring gear 114 to rotate as the differential gear 116*a* is in one embodiment locked. The ring gear 114 may be configured to transfer power to the main shaft 132 through a jack shaft 115 and drive gear 130. The piston driving gear 128 turns the follower coupling gear 126, causing the follower arm 144*a* to rotate about the follower shaft 122*a*, whereupon the cam follower 142*a* may roll unconstrained in the cam groove 136. During a designed burn dwell, the cam groove 136 constrains the cam follower 142*a* to reduce the relative expansion rate of the combustion chamber 72, or to hold the combustion chamber 72 volume constant. Note that during a burn dwell, the cam 36 may be configured to move the power input 12*b* at a speed up to the same speed as the power input 12*a*.

Note that the jack shaft 115 is given by way of example of a power transfer mechanism from the differential 116*a*-116*d* to the main shaft 132. In another example, a pinion shaft may be placed between the differential gears 116*c*-116*d*, and coupled to the main shaft 32 such that when the exploded planetary gears rotate about the main shaft 32 power is supplied to the main shaft. Without limitation this method is also considered within the scope of the present invention.

The power input 12*b* operates in the example as follows. Power input 12*b* is coupled 118 to the piston driving gear 148 and differential gear 116*a*. The coupler 118 may comprise a hollow shaft 118 such that power input 12*b* directly drives the gears 148, 116*a*, and allows the main shaft 132 to pass therethrough. When power input 12*b* provides power and power input 12*a* may be locked by the cam 136, power input 12*b* turns the differential gear 116*a*, causing the ring gear 114 to rotate as the differential gear 116*b* may be locked. Ring gear 114 may be configured to transfer power to the main shaft 132 through a jack shaft 115 and drive gear 130. The piston driving gear 148 will turn the follower coupling gear 146, causing the follower arm 144*b* to rotate about the follower shaft 122*b*, whereupon the cam follower 142*b* may roll unconstrained in the cam groove 136. During a designed burn dwell, the cam groove 136 will constrain the cam follower 142*b* to reduce the relative expansion rate of the combustion chamber 60, or to hold the combustion chamber 60 volume constant. Note that during a burn dwell, the cam 36 may be configured to move the power input 12*a* at a speed up to the same speed as the power input 12*b*.

A flywheel 140 may also have a geared starter ring 150 secured thereto, or monolithically formed therewith, for engaging a starter motor or the like. In some embodiments, magnets may mount to the flywheel 140 and serve as the rotator of an alternator. In some embodiments, magnets may be configures such that the flywheel 140 also serves as the armature of a motor used to start the engine 10, in which case a separate starter motor would be unnecessary. A flywheel 140 may also have vanes thereon and serve to cool the engine 10.

Figure 11:
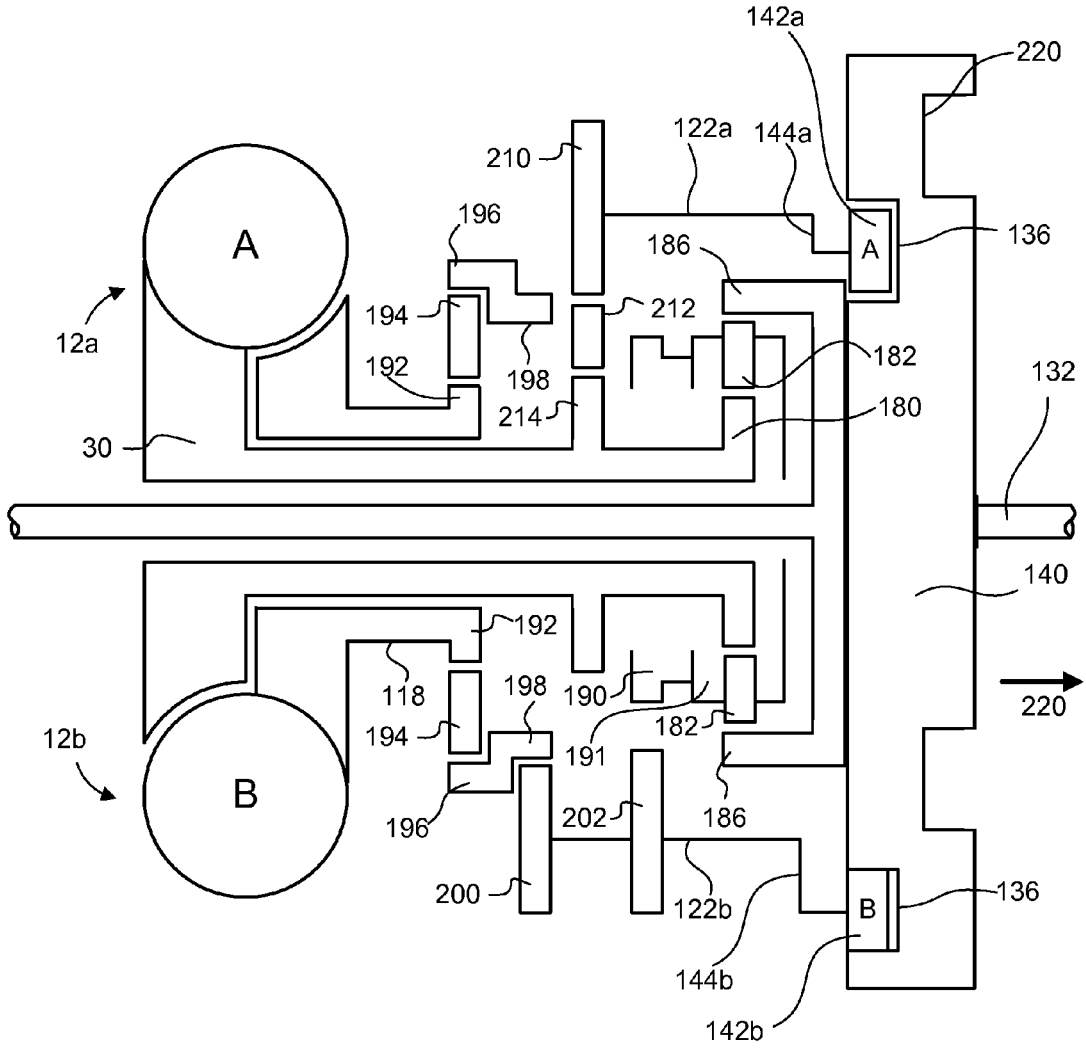
FIG. 11 is a schematic representation of a differential having epicyclic planetary gearing, in accordance with the present invention.

Referring to FIG. 11, in some embodiments, the differential may be embodied as an epicyclic planetary gear set 194, 182.

The embodiment shown in FIG. 11 functions as follows. When the power input A is providing power, power input A is coupled 30 to rim gear 214 and sun gear 180. While cam follower 142*b* is locked, the linking gear 202 is locked, and therefore rim gear 190 is locked, preventing the carrier 191 from rotating and allowing planetary gears 182 to orbit sun gear 180. Therefore, planetary gears 182 must rotate in place, forcing ring gear 186 to rotate, which is coupled to the flywheel 140 and the main shaft 132. Rim gear 214 drives stationary gear 212 which drives follower gear 210. The follower arm 122*a* therefore turns causing the follower 144*a* to rotate freely in the cam 136 except during a burn dwell as described above under FIG. 10.

When the power input B is providing power, power input B is coupled 118 to sun gear 192 which drives planetary gears 194, rim gear 196, ring gear 198 and therefore follower gear 200. The linking gear 202 is unlocked, therefore the rim gear 190 rotates causing the carrier 191 to rotate. While cam follower 142*a* is locked, follower gear 210, stationary gear 202, and rim gear 214 are likewise locked. Therefore, sun gear 180 is locked, and the rotating carrier 191 drives the planetary gears 182, ring gear 186, and therefore the flywheel 140. The follower arm 122*b* turns and causes the follower 142*b* to rotate freely in the cam 136 except during a burn dwell as described above under FIG. 10.

Some embodiments of the engine 10 may have multiple stages. That is to say, multiple toroidal chambers, each with a corresponding piston assemblies 12*a*,12*b*, differential, guides 136, and followers 134*a*, 134*b*, may drive a single output shaft 132. In some embodiments, a second guide 220 may be formed in a face of the flywheel 140 opposite the first guide 136. In such an embodiment, the differential, followers 134*a*, 134*b*, and piston assemblies 12*a*, 12*b* of the second stage may simply be a mirror image of the first stage positioned next to the second guide 220. The second guide 220 may be a mirror image of the first guide 136. In one embodiment, the second guide 220 is rotated 45 degrees about the output shaft 132. In the some embodiments of the engine 10, a combustion stroke will occur in the toroidal chamber once for every 90 degree rotation of the flywheel 140. Accordingly, shifting the guide 220 of the second stage 45 degrees ensures that a combustion stroke will occur for every 45 degree rotation of the flywheel, resulting in a more constant output torque and reduced vibration.

In some embodiments, the engine 10 may have a first stage operating on an Alpha cycle, connected to a first guide 136, and a second stage operating on a Beta cycle, connected to a second guide 220. In such a configuration, the first stage of the engine 10 provides power, and the second stage of the engine 10 performs work—for example by compressing air.

Figure 12:
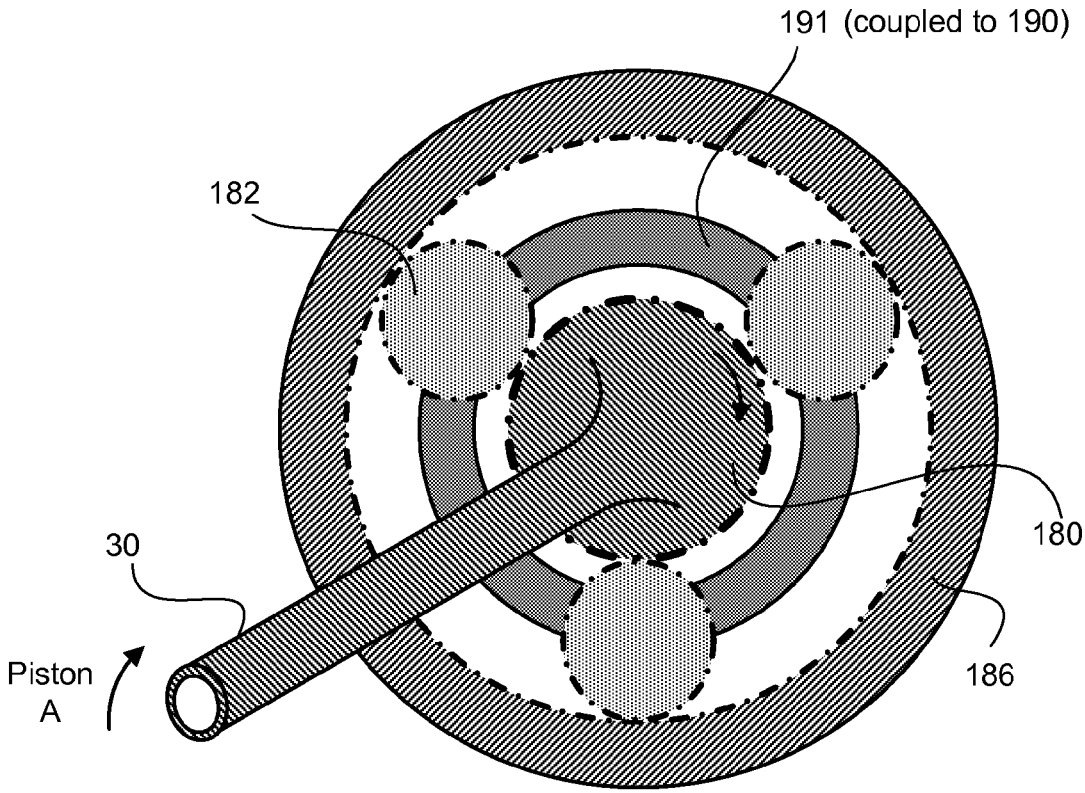
FIG. 12 is a schematic illustration of a carrier and epicyclic planetary gear, in accordance with the present invention.

FIG. 12 is a schematic illustration of a carrier 191 and epicyclic planetary gear 182, in accordance with the present invention to clarify aspects of the embodiment of FIG. 11. When piston A powers, piston A is coupled 30 to a sun gear 180. The carrier 191 is locked when piston B is locked, and therefore the planetary gears 182 rotate in place, and force the ring gear 186 to rotate in the opposite direction of the sun gear 180.

When piston B powers, piston B rotates the carrier 191 (see FIG. 11 description). When piston A is locked, the sun gear 180 is locked, and the planetary gears 182 revolve around the sun gear 180 with the carrier 191. Therefore, the ring gear 186 rotates in the same direction as the carrier 191.

The ring, planetary, and sun gears are related as shown in Equation 1. As used below, $\Omega_s$, $\Omega_r$, and $\Omega_c$ represent the rotation speeds of the sun, ring, and carrier, while $r_s$, $r_r$, and $r_c$ are the radii of the sun, ring, and carrier gears. It is understood that use of the radius works when the gear teeth are configured to provide similar linear displacements with each tooth engagement, but that gear tooth ratios could be used if desired.

$$\Omega_s r_s = \Omega_r r_r \pm 2\Omega_c r_c \qquad \text{Equation 1.}$$

Figure 13:
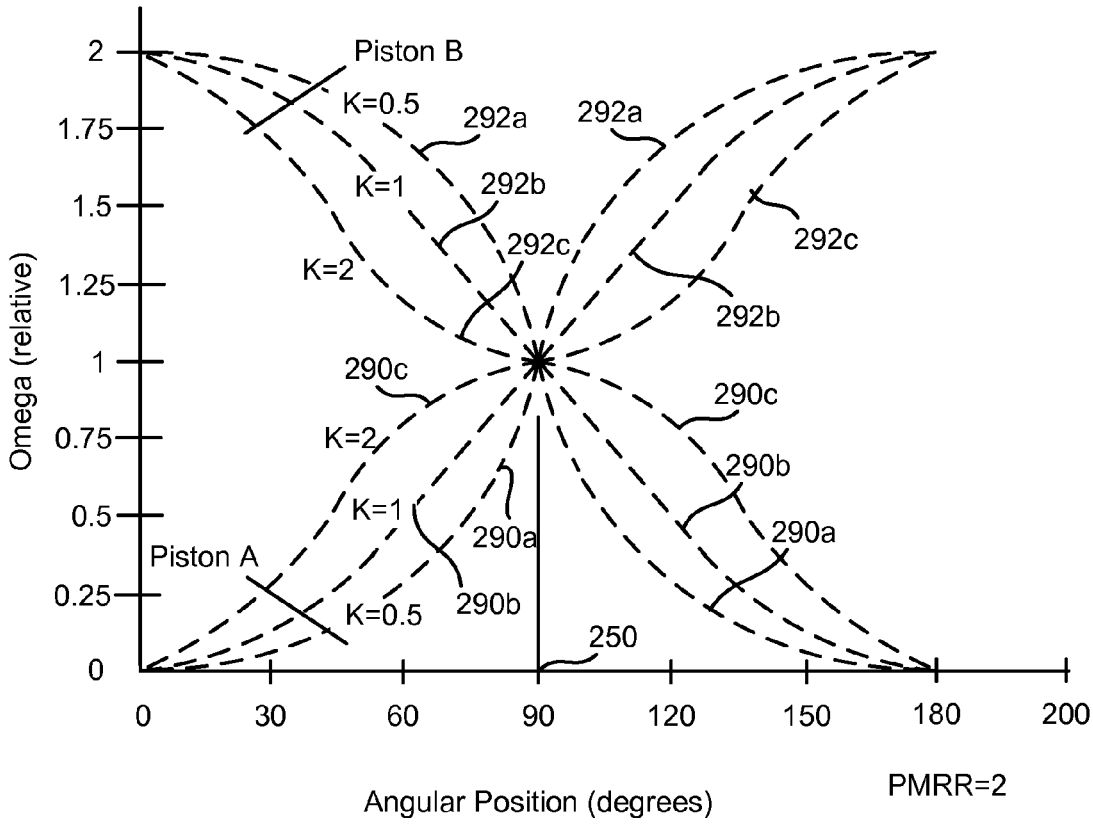
FIG. 13 is a graph of velocity profiles of piston assemblies, in accordance with the present invention.

FIG. 13 illustrates a plot of the angular velocity of the piston assemblies 12*a*, 12*b* versus angular position. Plots 290*a*-290*c* represent various possible velocity profiles for the first 180 degrees of rotation of piston assembly 12*a*. Plots 292*a*-292*c* represent various possible velocity profiles for piston assembly 12*b*. Plots 292*a*-292*c* also reflect possible velocity profile of piston assembly 12*a* during the second 180 degrees of its rotation, just as plots 290*a*-290*c* also represents possible velocity profiles for piston assembly 12*b* during the second 180 degrees of its rotation. A velocity profile may be generated by the considerations of the mechanical parts of an embodiment, as well as the desired combustion characteristics.

The plots 290*a*-290*c* and plots 292*a*-292*c* illustrate velocity profiles utilizing a continuous function and having pseudo-dwells of differing duration. The flat area where both 12*a*, 12*b* have nearly identical velocities represent the pseudo-dwell location. In some embodiments, Equations 2 and 3 may be utilized to develop a velocity profile.

$$\Omega_b(\text{relative}) = (PMRR * (1 + (ABS(\text{Cos}(Dx)))\hat{}K)/2) \qquad \text{Equation 2.}$$

$$\Omega_a(\text{relative}) = (PMRR - \Omega_b) \qquad \text{Equation 3.}$$

In the equations, Ω represents the relative angular velocity of 12*a* or 12*b*, Dx represents the current angular displacement of the power input 12*a* or 12*b*, and PMRR is the piston to main rotation ratio, or the number of times a piston A,B,A',B' completes a revolution per turn of the flywheel 140. K represents an arbitrary value, where values of K at 1 or below do not have a dwell time, and values of K above 1 have a pseudo-dwell. The velocity profiles of Equation 2 and 3 only produce a pseudo-dwell because they do not literally bring the power inputs 12*a*, 12*b* to identical speeds. However, with a K value of 2, and PMRR=2 (curve 292*c*), the velocities of 12*a*, 12*b* are within about 1% of each other from 85 to 95 degrees, and within about 6% of each other from 80 to 100 degrees.

Any substantially constant velocity between opposing pistons will create a burn-dwell and derive some of the Plot area 94 work (see FIG. 8) from the combustion cycle, and will therefore suffice for the purposes of the invention. Substantially constant velocity will vary with the application, but at least values where the pistons have a velocity within 10% of each other should be considered substantially constant, but also any value that makes the Plot area 94 efficiency valuable compared to the cost of higher combustion pressures should also be considered a valuable burn-dwell and therefore would be a substantially constant velocity. A true dwell can be imposed, of course, but it would require a discontinuity in the velocity profiles which may introduce clatter, backlash, and wear in the physical gearing mechanisms and wear on the physical systems. K can be selected arbitrarily high to approach arbitrarily close to a true dwell.

As discussed hereinabove, dwells are portions of the cycle in which both piston assemblies 12*a*, 12*b* move in unison in order to enable constant volume combustion of the fuel air mixture. The plots 290*a*-290*c* are identical to the plots 292*a*-292*c* shifted 180 degrees.

Referring to plots 290*a*-290*c*, at zero degrees piston 12*a* may begin at zero velocity, serving to define a combustion chamber as piston 12*b* moves at its maximum velocity during the combustion process, as shown in plots 292*a*-292*c*. As piston assembly 12*b* decelerates from its maximum velocity at zero degrees to the dwell velocity at approximately 90 degrees, as shown in plots 292*a*-292*c*, piston assembly 12*a* accelerates to the dwell velocity, as shown in plots 290*a*-290*c*, such that at 90 degrees both piston assemblies 12*a*, 12*b* have the same velocity. For configurations having a dwell, the piston assemblies 12*a*, 12*b* will have substantially the same velocity from slightly before 90 degrees until slightly after as illustrated in plots 290*c*, 292*c*.

At the point where the piston assemblies achieve the same velocity, the fuel air mixture has been compressed and is prepared for ignition. Accordingly, at, or slightly after 90 degrees the fuel air mixture is ignited and piston 12*a* begins to accelerate as it moves toward the 180 degree position where it achieves its maximum velocity, as shown in plots 290*a*-290*c*. Piston 12*b*, on the other hand, at or slightly after 90 degrees, begins to decelerate until it reaches zero velocity at 180 degrees. At this point, the cycle repeats, except plots 290*a*-290*c* represent the velocity profile of piston 12*b* and plots 292*a*-292*c* represent the velocity profile of piston 12*a*.

Figure 14:
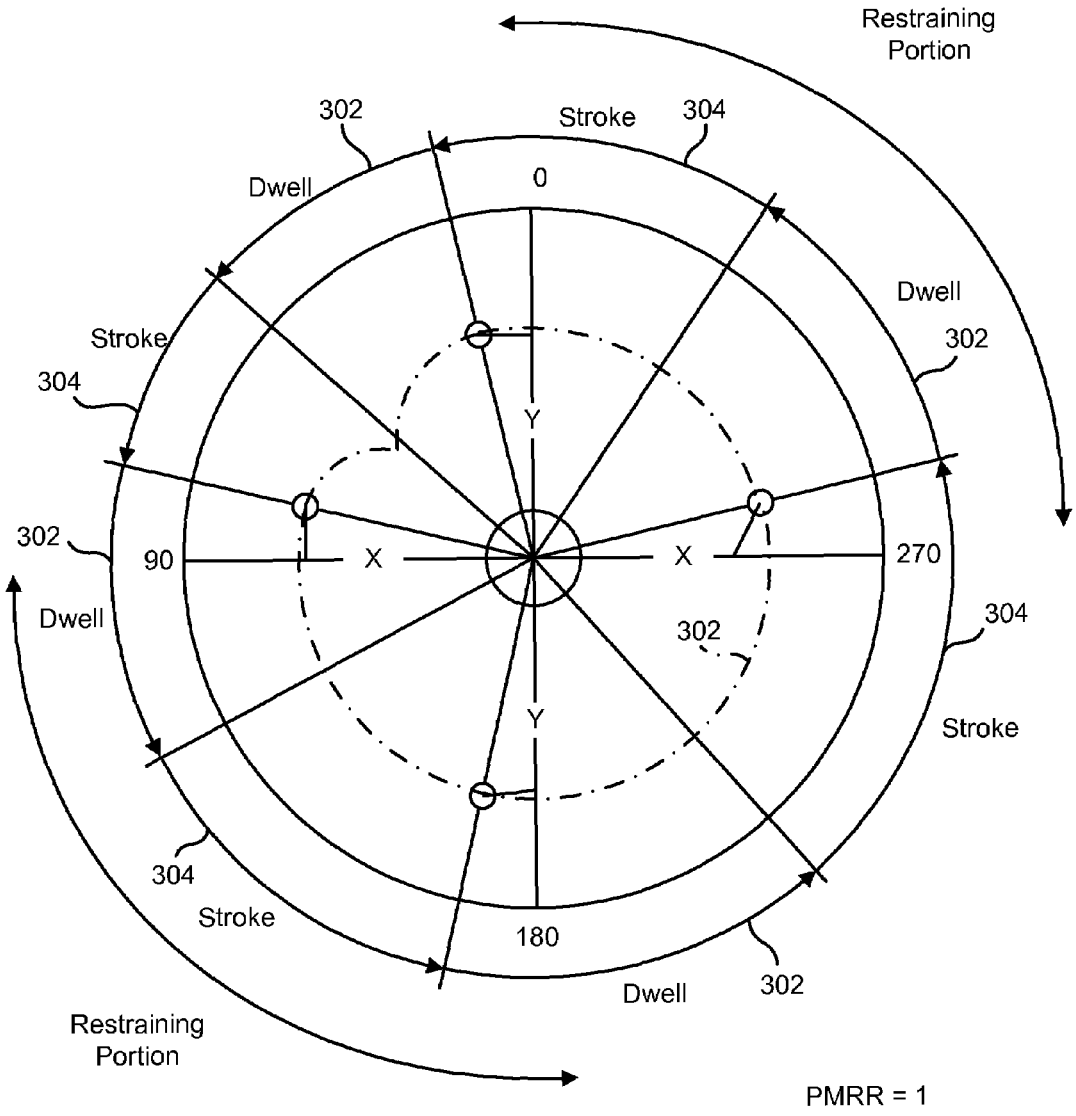
FIG. 14 is a schematic representation of a cam profile suitable for use in the present invention.

Referring to FIG. 14, a guide 136 may be embodied as a cam 136, such as a groove 136, or raised rail 136. The cam profile 300 may be chosen to cause the piston assemblies 12*a*, 12*b* to have the velocity profile of FIG. 13. As discussed in conjunction with FIGS. 10-11, followers 134*a*, 134*b* may be embodied as rollers 142*a*, 142*b* attached to arms 144*a*, 144*b*, which drive follower shafts 122*a*, 122*b*. As the flywheel 140 is rotated, the cam 136 causes the followers 134*a*, 134*b* to rotate. Due to the coupling between the followers 134*a*, 134*b* and the piston assemblies 12*a*, 12*b*, as discussed in conjunction with FIGS. 10-11, the rotation of the followers 134*a*, 134*b* causes corresponding rotation of the pistons 12*a*, 12*b*.

The various portions of the cam 136 may be described as dwell portions 302, in which the pistons 12*a*, 12*b* are made to move in unison at nearly constant velocity, and stroke portions 304, in which the piston assembly 12*a*, 12*b* move accelerate and decelerate at different rates. The cam profile may be derived mathematically or numerically from the velocity profile described in FIG. 11 by tracing back through the gearing to determine what positions and angular velocities of the followers 134*a*, 134*b* correspond to the desired positions and angular velocities of the piston assemblies 12*a*, 12*b*.

Figure 15:
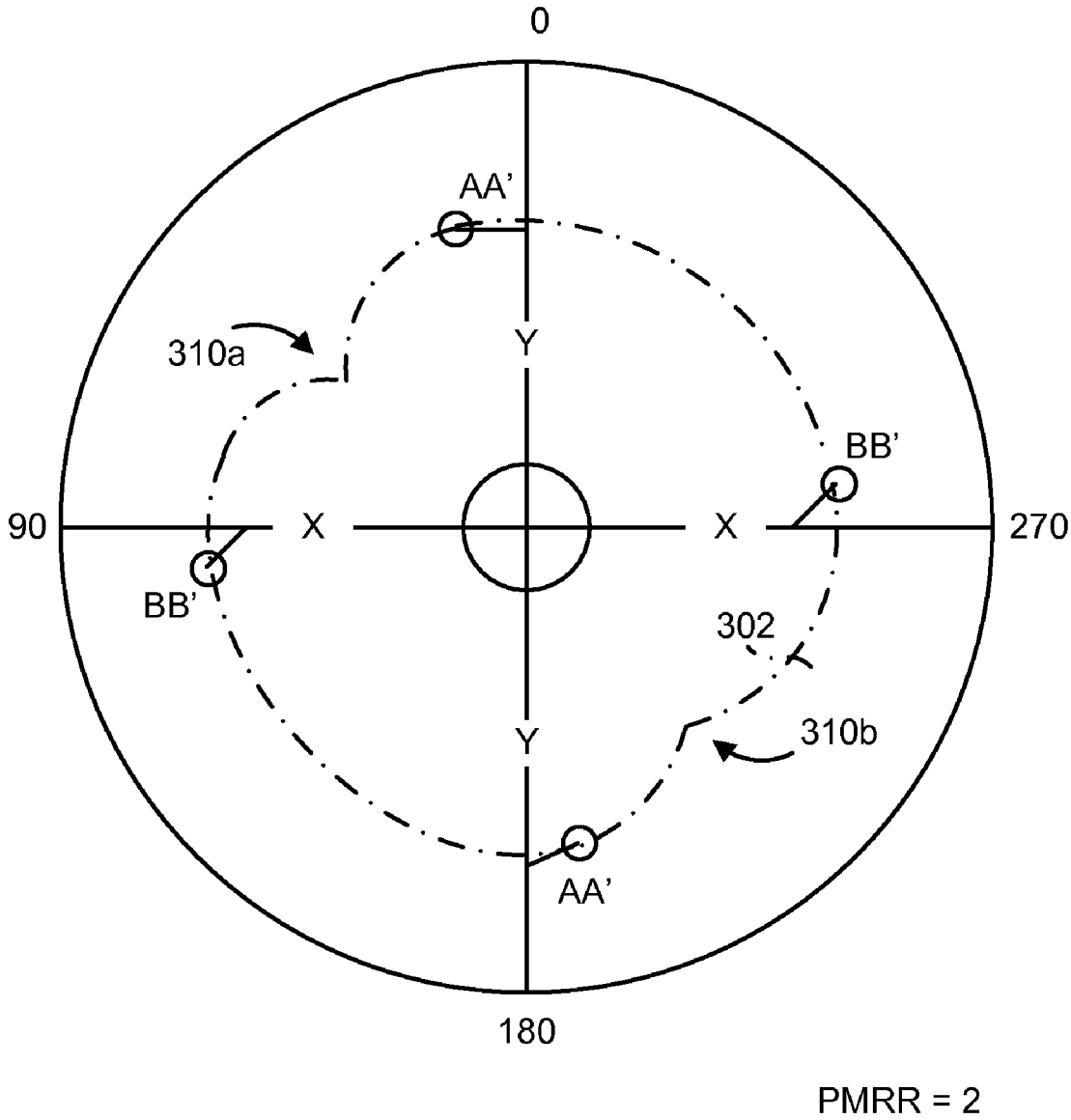
FIG. 15 is a schematic representation of a cam profile having two lobes, in accordance with the present invention.

Referring to FIG. 15, in some embodiments, the flywheel may experience one complete revolution for every two revolutions of the piston assemblies 12*a*, 12*b*. Accordingly, the cam profile may have two lobes 310*a*, 310*b*, with each lobe controlling the piston assemblies 12*a*, 12*b* through an entire revolution thereof. A cam profile with two lobes provides the benefit that the flywheel 140 is more closely balanced than a cam profile with a single eccentric lobe such as the one in FIG. 14.

Figure 16:
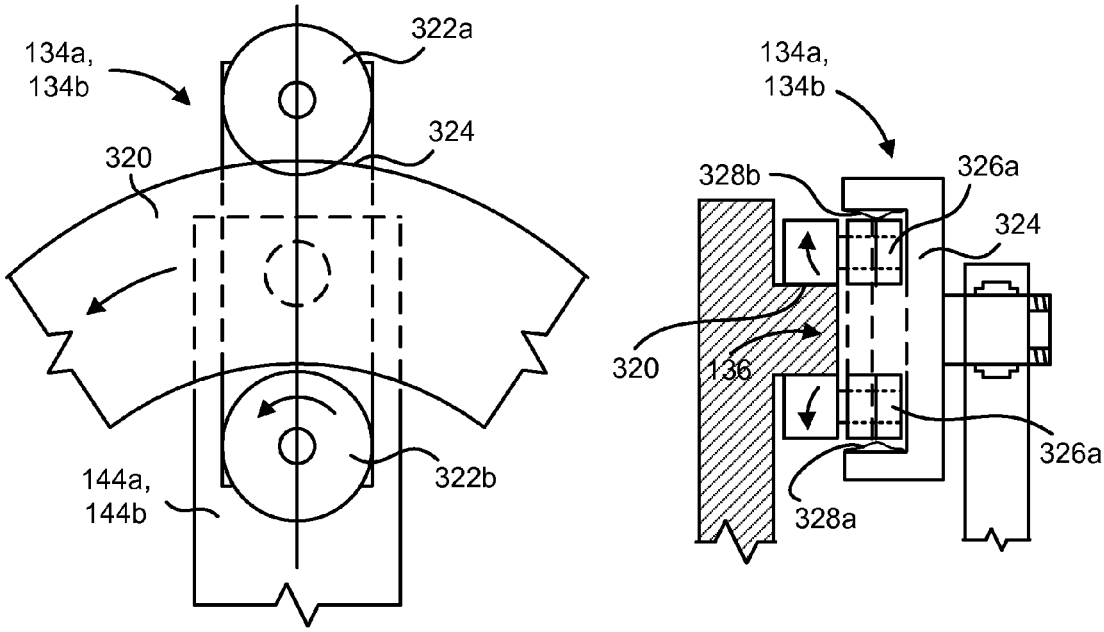
FIG. 16 is a front and side view of a cam follower, in accordance with the present invention.

Referring to FIG. 16, the cam 136 and followers 134*a*, 134*b* may have any configuration known in the art of machine design. In one embodiment, the followers 134*a*, 134*b* are embodied as rollers 142*a*, 142*b* rotatably secured to the follower arms 144*a*, 144*b*. Alternatively, a cam 136 may be embodied as a rail 320 and the followers 134*a*, 134*b* may be embodied as two rollers 322*a*,322*b* rotatably mounted to an arm 324. The arm 324 may be rotatably mounted to the follower arms 144*a*, 144*b*.

In some embodiments, the rollers 322 may mount to slider blocks 326*a*, 326*b* slidably mounted to the arm 324. Biasing members 328*a*,328*b* may urge the rollers 322 into engagement with the rail 320. In the illustrated embodiment, the biasing members 328*a*,328*b* are Bellville springs situated to push the slider blocks 326*a*,326*b* toward one another. Biasing the rollers 322*a*,322*b* toward the cam may ensure firm contact between the rollers 322*a*,322*b* and the rail 320 thereby reducing clatter and backlash.

Figure 17:
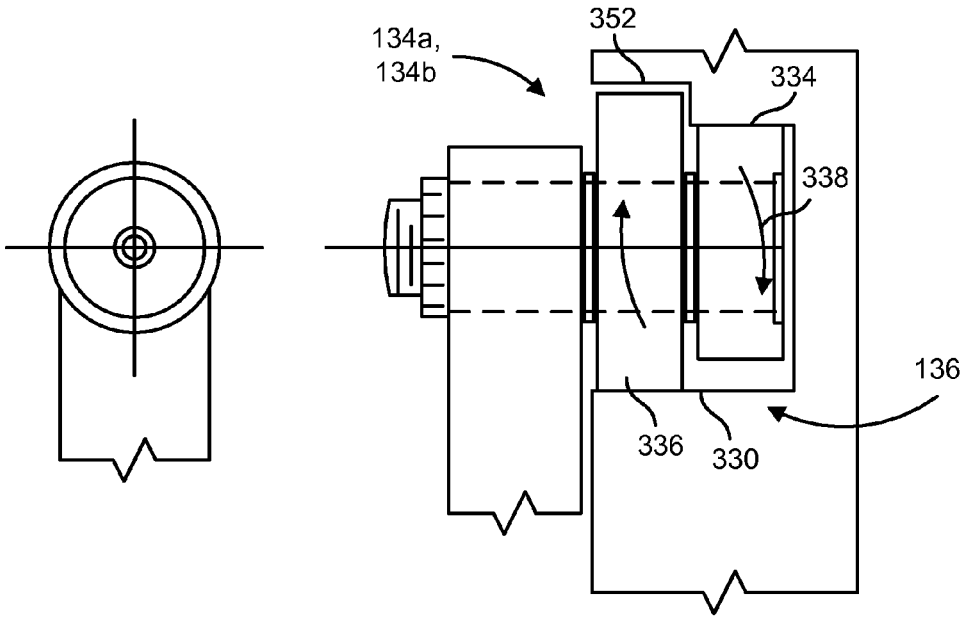
FIG. 17 is a side view of an alternative embodiment of a cam follower in accordance with the present invention.

Referring to FIG. 17, a guide 136 may be embodied as a groove 330. In some embodiments, the groove 330 may have a wide portion 332 and a narrow portion 334. In such embodiments, a roller 142*a*, 142*b* may be substituted with a large roller 336 and a smaller roller 338 corresponding to the wide portion 332 and narrow portion 334 of the groove 330, respectively. The wide portion 332 and narrow portion 334 of the groove 330 may be offset from one another such that opposite sides of the rollers 336, 338 are kept in contact with the walls of the groove 330. In some embodiments, the shaft 340 to which the rollers 336, 338 secure may be compliant, biasing the rollers 336, 338 toward contact with opposite walls of the groove 330 in order to reduce clatter and backlash.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for converting power, with intermittent power on one side and continuous power on the other, the system comprising:

a main power conduit comprising a main shaft coupled to a flywheel, the main power conduit energetically coupling a first continuous power device and a second intermittent power device comprising a plurality of power elements;

a gear case coupled to the main power conduit configured to perform one of transferring power from the first power device to the second power device, and transferring power from the second power device to the first power device, the gear case comprising:

a planetary differential gear set configured to allow each of the plurality of power elements to rotate at a variable rate;

a locking device configured to control the relative velocity and position of the plurality of power elements, the locking device comprising:

a plurality of cam followers engaging a cam supported on the flywheel, each cam follower operatively coupled to one of the plurality of power elements, wherein the position of each cam follower correlates to the position of the corresponding power element; and the cam having a continuous control surface configured to guide each of the plurality of the cam followers along a closed path that forms a closed loop.

2. The system of claim 1, wherein the planetary differential gear set comprises an exploded planetary gear set.

3. The system of claim 1, wherein the planetary differential gear set comprises an epicyclic planetary gear set.

4. The system of claim 1, wherein power flows from the first power device to the second power device, wherein the second power device outputs power as an intermittent stream of compressed gas.

5. The system of claim 4, wherein power flows from the second power device to the first power device.

6. The system of claim 1, wherein the plurality of power elements comprises a first piston assembly and a second piston assembly, the second power device further comprising a housing defining a toroidal chamber, the first piston assembly and second piston assembly positioned within the toroidal chamber.

7. The system of claim 6, wherein the toroidal chamber has a circular cross section.

8. The system of claim 7, wherein the toroidal chamber has a rectangular cross section.

9. A rotary engine comprising:

a power conduit comprising a main shaft coupled to a flywheel;

a plurality of power inputs, the power inputs each comprising at least one piston secured to a hub;

a housing enclosing the power inputs, the housing and hubs of the power inputs defining a toroidal chamber;

a planetary differential gear set configured to allow each power input to rotate at a variable rate;

a locking device configured to control the relative velocity and position of the plurality of power inputs, the locking device comprising:

a plurality of cam followers engaging a cam supported on the flywheel, each follower operably connected to one power input, wherein the position of each cam follower correlates to the position of the corresponding power input; and the cam has a continuous control surface configured to guide each of the plurality of the cam followers along a closed path that forms a closed loop.

10. The rotary engine of claim 9, wherein the planetary differential gear set is an exploded planetary gear set.

11. The rotary engine of claim 10, wherein the planetary differential gear set is an epicyclic planetary gear set.

12. The rotary engine of claim 9, wherein each cam follower is coupled to a follower shaft, wherein the cam is a groove defining the closed path, and wherein the closed path constrains the power inputs to follow a designed relative velocity profile.

13. The rotary engine of claim 12, wherein the designed velocity profile comprises sequential regions of zero velocity, acceleration, substantially constant velocity, and deceleration.

14. The rotary engine of claim 9, further comprising at least one intake port and one exhaust port, the engine configured to accept fluid in a high energy state through the at least one intake port, expand the fluid such that one of the power inputs applies power to a main power output shaft thereby converting the fluid in a high energy state to fluid in a low energy state, and to vent the fluid in a low energy state through the at least one exhaust port.

15. A rotary engine comprising:

a power conduit comprising a main shaft coupled to a flywheel;

a first and a second power input, each power input comprising a piston, a counter piston, and a hub, the piston and counter piston secured to the hub opposite one another;

a housing enclosing the first and second power inputs, the housing and hubs of the first and second piston power inputs defining a toroidal chamber;

a planetary differential gear set configured to allow each power input to rotate at a variable rate;

a locking device configured control the relative velocity and position of the plurality of power inputs, the locking device comprising:

a plurality of cam followers, each cam follower operably connected to one power input, wherein the position of each cam follower correlates to the position of the corresponding power input; and a continuous control surface cam configured to guide each of the plurality of the cam followers along a closed path that forms a closed loop, wherein the cam comprises a groove in the flywheel.

16. The rotary engine of claim 15, further comprising:

four combustion chambers, each combustion chamber comprising a portion of the toroidal chamber between a piston of the first power input and a piston of the second power input;

at least one intake port and at least one exhaust port, the intake and exhaust ports configured with the locking device to cause each combustion chamber to sequentially experience the phases of:

fluid intake;

fluid compression;

fluid constant-volume dwell time;

fluid expansion; and fluid exhaust.

17. The rotary engine of claim 16, further comprising:

a fuel supply device configured to add fuel to a compressed air supply such that each combustion chamber has a fuel-air mixture before the fluid expansion phase; and at least one spark source configured to ignite the fuel-air mixture at a time before the fluid expansion phase begins.

18. The rotary engine of claim 17, wherein the rotary engine is configured to run a hyper-expansion cycle comprising:

at least one hyper-expansion port configured to reduce the fluid mass remaining in the combustion chamber at the end of one of the fluid intake and compression phases;

wherein the at least one hyper-expansion port, at least one intake port, at least one exhaust port, and locking device are configured such that the post-combustion pressure of the combustion chamber at the end of the fluid expansion phase is substantially near atmospheric pressure.

19. The rotary engine of claim 18, wherein the rotary engine further comprises an electronic control module configured to manipulate by opening and closing the hyper-expansion port such that a constant fluid mass remaining in the combustion chamber at the end of the fluid intake phase is achieved through wide range of ambient air pressures.

20. The rotary engine of claim 18, wherein the rotary engine further comprises an electronic control module configured to inject fuel and ignite the fuel-air mixture in one of the combustion chambers such that the rotary engine begins operation without an external starting mechanism.

21. The rotary engine of claim 15, further comprising:

at least one fuel injection device configured to add fuel to the combustion chamber substantially near the end of the fluid compression phase such that the fuel ignites in the compressed fluid of the combustion chamber.

22. The rotary engine of claim 21, wherein the rotary engine is configured to run a hyper-expansion cycle comprising:

at least one hyper-expansion port configured to reduce the fluid mass left in the combustion chamber at the end of the fluid intake phase;

wherein the at least one hyper-expansion port, at least one intake port, at least one exhaust port, and locking device are configured such that the post-combustion pressure of the combustion chamber at the end of the fluid expansion phase is substantially near atmospheric pressure.

23. The rotary engine of claim 15, wherein the pistons and counter pistons are scalloped.

24. The rotary engine of claim 15, the engine configured such that the first and second power inputs make two rotations for each rotation of the flywheel, wherein the cam comprises the groove having two lobes.

25. An energy conversion device comprising:

at least one compression-expansion chamber comprising a toroidal segment, defined by a housing, a first and second hub, a first piston coupled to the first hub, and a second piston coupled to the second hub;

a power conduit comprising a main shaft coupled to a flywheel;

wherein the compression-expansion chamber is energetically coupled to the power conduit by a planetary differential gear system;

a locking device comprising a plurality of cam followers engaging a cam supported on the flywheel, the cam followers connected by a planetary coupling to the first piston, and the second piston, the locking device configured to control the relative velocity and position of the first piston and the second piston;

at least one intake port configured to contribute to one of an alpha cycle and a beta cycle;

at least one exhaust port configured to contribute to one of an alpha cycle and a beta cycle;

wherein the alpha cycle comprises receiving high energy fluid before an expansion phase of the at least one compression-expansion chamber, and releasing low energy fluid after the expansion phase of the at least one compression-expansion chamber;

wherein the beta cycle comprises receiving low energy fluid before a compression phase of the at least one compression-expansion chamber, and releasing high energy fluid after the expansion phase of the at least one compression-expansion chamber; and wherein the power conduit is configured to accept net energy from the high energy fluid for an energy conversion device operating on the alpha cycle, and wherein the power conduit is configured to contribute net energy to the low energy fluid for an energy conversion device operating on the beta cycle.

26. The energy conversion device of claim 25, further comprising a second energy conversion device configured to share the flywheel and power conduit of the first energy device, wherein the first and second energy devices both operate on an alpha cycle and contribute net energy to the power conduit.

27. The energy conversion device of claim 25, further comprising a second energy conversion device configured to share the flywheel and power conduit of the first energy device, wherein the first energy device is configured to operate on an alpha cycle and contribute net energy to the power conduit, and where in the second energy device is configured to operate on a beta cycle and receive net energy from the power conduit.

28. The energy conversion device of claim 27, wherein the second energy conversion device comprises an air compressor.

* * * * *